US007057354B2

(12) United States Patent
Wong et al.

(10) Patent No.: US 7,057,354 B2
(45) Date of Patent: Jun. 6, 2006

(54) FREQUENCY CONTROLLED LIGHTING SYSTEM

(75) Inventors: Wai Kai Wong, Kowloon (HK); Lai Cheong Mak, Kowloon (HK)

(73) Assignee: Cheerine Development (Hong Kong) Limited (HK)

( * ) Notice: Subject to any disclaimer, the term of this patent is extended or adjusted under 35 U.S.C. 154(b) by 48 days.

(21) Appl. No.: 10/839,520

(22) Filed: May 5, 2004

(65) Prior Publication Data

US 2005/0057188 A1 Mar. 17, 2005

Related U.S. Application Data

(63) Continuation-in-part of application No. 10/662,796, filed on Sep. 15, 2003.

(51) Int. Cl.

| | |
|---|---|
| ***H05B 37/00*** | (2006.01) |
| ***H05B 39/00*** | (2006.01) |
| ***H05B 39/09*** | (2006.01) |
| ***H05B 41/14*** | (2006.01) |
| ***H05B 41/30*** | (2006.01) |

(52) U.S. Cl. ..... 315/200 A; 362/227; 362/802; 362/103

(58) Field of Classification Search ..... 362/103, 362/227, 251, 802; 315/200 A, 225
See application file for complete search history.

(56) References Cited

U.S. PATENT DOCUMENTS

| | | | | |
|---|---|---|---|---|
| 1,597,823 | A | 8/1926 | Randolph | |
| 1,933,243 | A | 10/1933 | De Merolis et al. | 36/2.5 |
| 2,572,760 | A | 10/1951 | Rikelman | 36/1 |
| 2,634,407 | A | 4/1953 | Johnson | 340/321 |
| 2,671,209 | A | 3/1954 | Habib | 340/261 |
| 2,671,847 | A | 3/1954 | Lerch | 240/6.4 |
| 2,816,284 | A | 12/1957 | Campanell | 340/321 |
| 2,849,819 | A | 9/1958 | Murphy et al. | 46/230 |
| 2,931,893 | A | 4/1960 | Gonzales et al. | 240/6.4 |
| 2,959,892 | A | 11/1960 | Johnson | 46/228 |
| 2,976,622 | A | 3/1961 | Shearouse | 36/1 |
| 3,008,038 | A | 11/1961 | Dickens et al. | 240/6.4 |
| 3,053,949 | A | 9/1962 | Johnson | 200/61.49 |
| 3,070,907 | A | 1/1963 | Rocco | 36/8.3 |

(Continued)

FOREIGN PATENT DOCUMENTS

CN 2063363 U 10/1990

(Continued)

OTHER PUBLICATIONS

Combined Search and Examination Report dated Jul. 15, 2003, for corresponding United Kingdom application GB 0306157.9.

*Primary Examiner*—Thuy V. Tran
*Assistant Examiner*—Angela M Lie
(74) *Attorney, Agent, or Firm*—Brinks Hofer Gilson & Lione

(57) ABSTRACT

A method and apparatus for illuminating lighting elements in one or more predetermined patterns. A preferred frequency controlled lighting system implementing this method includes a motion switch, a controller, a sound generator, and lighting elements. The motion switch creates an activation signal in response to movement of the motion switch, which is detected by the controller. In response to the properties of the activation signal, the controller illuminates the lighting elements in one or more predetermined patterns, or the controller actuates the sound generator to generate sound. Preferably, the lighting system utilizes at least two integrated circuits where a first integrated circuit functions as the controller and a second integrated circuit, having a higher cutoff operating voltage than the first integrated circuit, functions as the sound generator.

9 Claims, 14 Drawing Sheets

U.S. PATENT DOCUMENTS

| | | | | | |
|---|---|---|---|---|---|
| 3,502,831 | A | | 3/1970 | McRoskey | 36/8.3 |
| 3,564,232 | A | | 2/1971 | Ellerbe | 240/604 |
| 3,731,022 | A | | 5/1973 | Loftus | 200/61.49 |
| 3,800,133 | A | | 3/1974 | Duval | 240/6.4 W |
| 3,893,247 | A | | 7/1975 | Dana, III | 36/2.5 K |
| 3,946,505 | A | | 3/1976 | Dana, III | 36/2.5 K |
| 3,968,641 | A | | 7/1976 | Moyer | 58/50 R |
| 4,009,387 | A | | 2/1977 | Nuver | 250/205 |
| 4,014,115 | A | | 3/1977 | Reichert | 36/137 |
| 4,020,572 | A | | 5/1977 | Chiaramonte, Jr. | 36/137 |
| 4,128,861 | A | | 12/1978 | Pelengaris | 362/103 |
| 4,130,951 | A | | 12/1978 | Powell | 36/137 |
| 4,158,922 | A | | 6/1979 | Dana, III | 36/137 |
| 4,231,079 | A | | 10/1980 | Heminover | 362/106 |
| 4,253,253 | A | | 3/1981 | McCormick | 36/137 |
| 4,298,917 | A | | 11/1981 | Ware | 362/157 |
| 4,308,572 | A | | 12/1981 | Davidson et al. | 362/103 |
| 4,350,853 | A | | 9/1982 | Ganyard | 200/52 R |
| 4,363,502 | A | | 12/1982 | Bakerman | 280/816 |
| 4,367,515 | A | | 1/1983 | Beard | 362/103 |
| 4,412,205 | A | | 10/1983 | Von Kemenczky | 340/331 |
| 4,422,719 | A | | 12/1983 | Orcutt | 350/96.3 |
| 4,459,645 | A | | 7/1984 | Glatter | 362/104 |
| 4,463,412 | A | | 7/1984 | Broach | 362/61 |
| 4,489,957 | A | | 12/1984 | Holmgren | 280/810 |
| 4,518,274 | A | | 5/1985 | Hanggi | 401/195 |
| 4,588,387 | A | | 5/1986 | Swenson | 446/130 |
| 4,701,146 | A | | 10/1987 | Swenson | 446/130 |
| 4,765,701 | A | | 8/1988 | Cheslak | 350/96.1 |
| 4,800,469 | A | | 1/1989 | Leon | 362/72 |
| 4,823,240 | A | * | 4/1989 | Shenker | 362/103 |
| 4,848,009 | A | | 7/1989 | Rodgers | 36/137 |
| 4,870,325 | A | | 9/1989 | Kazar | 315/178 |
| 4,897,947 | A | | 2/1990 | Kass-Pious | 40/636 |
| 4,995,294 | A | | 2/1991 | Kashio et al. | 84/738 |
| 5,016,144 | A | | 5/1991 | DiMaggio | 362/35 |
| 5,027,035 | A | | 6/1991 | McGrail et al. | 315/119 |
| 5,033,212 | A | | 7/1991 | Evanyk | 36/137 |
| 5,052,131 | A | | 10/1991 | Rondini | 36/137 |
| 5,070,431 | A | | 12/1991 | Kitazawa et al. | 362/31 |
| 5,099,192 | A | | 3/1992 | Thayer et al. | 323/315 |
| 5,113,325 | A | | 5/1992 | Eisenbraun | 362/103 |
| 5,128,842 | A | | 7/1992 | Kenmochi | 362/95 |
| 5,188,447 | A | | 2/1993 | Chiang et al. | 362/103 |
| 5,235,761 | A | | 8/1993 | Chang | 36/3 R |
| 5,237,760 | A | | 8/1993 | Altman et al. | 36/137 |
| 5,285,586 | A | | 2/1994 | Goldston et al. | 36/137 |
| 5,303,131 | A | | 4/1994 | Wu | 362/103 |
| 5,303,485 | A | | 4/1994 | Goldston et al. | 36/137 |
| 5,309,145 | A | * | 5/1994 | Branch et al. | 340/540 |
| 5,313,187 | A | | 5/1994 | Choi et al. | 340/331 |
| 5,327,329 | A | | 7/1994 | Stiles | 362/61 |
| 5,343,190 | A | | 8/1994 | Rodgers | 340/573 |
| 5,353,441 | A | | 10/1994 | Lazorchak | 2/303 |
| 5,357,697 | A | | 10/1994 | Lin | 36/137 |
| 5,371,662 | A | | 12/1994 | Shen-Ko | 362/276 |
| 5,381,615 | A | | 1/1995 | MacMillan | 36/137 |
| 5,388,038 | A | | 2/1995 | Yang | 362/118 |
| 5,396,720 | A | | 3/1995 | Hwang et al. | 36/137 |
| 5,400,232 | A | | 3/1995 | Wong | 362/276 |
| 5,406,724 | A | | 4/1995 | Lin | 36/137 |
| 5,408,764 | A | | 4/1995 | Wut | 36/137 |
| 5,419,061 | A | | 5/1995 | Barrocas | 36/137 |
| 5,422,628 | A | | 6/1995 | Rodgers | 340/573 |
| 5,438,488 | A | | 8/1995 | Dion | 362/103 |
| 5,438,493 | A | | 8/1995 | Tseng | 362/103 |
| 5,455,749 | A | * | 10/1995 | Ferber | 362/103 |
| 5,456,032 | A | | 10/1995 | Matsumoto et al. | 40/636 |
| 5,457,900 | A | | 10/1995 | Roy | 36/137 |
| 5,461,188 | A | | 10/1995 | Drago et al. | 84/600 |
| 5,463,537 | A | | 10/1995 | Trattner et al. | 362/103 |
| 5,465,197 | A | | 11/1995 | Chien | 362/203 |
| 5,475,572 | A | | 12/1995 | Tseng | 362/78 |
| 5,477,435 | A | | 12/1995 | Rapisarda et al. | 362/189 |
| 5,477,437 | A | | 12/1995 | Lach | 362/252 |
| 5,483,759 | A | | 1/1996 | Silverman | 36/137 |
| 5,485,358 | A | | 1/1996 | Chien | 362/106 |
| 5,490,338 | A | | 2/1996 | Hwang et al. | 36/137 |
| 5,495,136 | A | | 2/1996 | Chiang et al. | 310/339 |
| 5,495,682 | A | | 3/1996 | Chen | 36/2.6 |
| 5,500,635 | A | | 3/1996 | Mott | 340/323 R |
| 5,508,899 | A | | 4/1996 | McCormick | 362/103 |
| 5,516,149 | A | | 5/1996 | Moore | 280/811 |
| 5,523,928 | A | | 6/1996 | Kim | 362/118 |
| 5,544,967 | A | | 8/1996 | Yao | 401/195 |
| 5,546,681 | A | | 8/1996 | Goldston et al. | 36/137 |
| 5,550,721 | A | | 8/1996 | Rapisarda | 362/205 |
| 5,552,971 | A | | 9/1996 | Madden | 362/61 |
| 5,566,479 | A | | 10/1996 | Gray et al. | 36/137 |
| 5,575,554 | A | | 11/1996 | Guritz | 362/103 |
| 5,577,828 | A | | 11/1996 | Nadel et al. | 362/103 |
| 5,588,734 | A | | 12/1996 | Talamo et al. | 362/61 |
| 5,590,945 | A | | 1/1997 | Simms | 362/31 |
| 5,599,088 | A | | 2/1997 | Chien | 362/103 |
| 5,604,999 | A | | 2/1997 | Barker | 36/137 |
| 5,617,304 | A | | 4/1997 | Huang | 362/118 |
| 5,644,858 | A | | 7/1997 | Bemis | 36/137 |
| 5,649,755 | A | | 7/1997 | Rapisarda | 362/31 |
| 5,653,523 | A | | 8/1997 | Roberts | 362/78 |
| 5,656,805 | A | | 8/1997 | Plesko | 235/472 |
| 5,663,614 | A | * | 9/1997 | Weng et al. | 315/360 |
| 5,664,862 | A | | 9/1997 | Redmond et al. | 362/31 |
| 5,673,996 | A | | 10/1997 | Ducker | 362/118 |
| 5,683,164 | A | | 11/1997 | Chien | 362/78 |
| 5,709,464 | A | | 1/1998 | Tseng | 362/276 |
| 5,716,119 | A | | 2/1998 | Patel | 362/32 |
| 5,722,757 | A | | 3/1998 | Chien | 362/32 |
| 5,730,520 | A | | 3/1998 | Hsu et al. | 362/78 |
| 5,730,539 | A | | 3/1998 | Chabria | 401/195 |
| 5,732,486 | A | | 3/1998 | Rapisarda | 36/137 |
| 5,735,592 | A | | 4/1998 | Shu | 362/118 |
| 5,746,499 | A | | 5/1998 | Ratcliffe et al. | 222/327 |
| 5,746,500 | A | | 5/1998 | Chien | 362/103 |
| 5,754,064 | A | | 5/1998 | Chien | 327/108 |
| 5,758,946 | A | | 6/1998 | Chen | 362/103 |
| 5,779,344 | A | * | 7/1998 | Tseng | 362/459 |
| 5,789,716 | A | | 8/1998 | Wang | 200/61.45 R |
| 5,812,063 | A | | 9/1998 | Weng et al. | 340/815.45 |
| 5,813,148 | A | | 9/1998 | Guerra | 36/137 |
| 5,821,858 | A | | 10/1998 | Stone | 340/573 |
| 5,839,814 | A | | 11/1998 | Roberts | 362/78 |
| 5,844,377 | A | | 12/1998 | Anderson et al. | 315/251 |
| 5,855,382 | A | | 1/1999 | Reilly et al. | 280/11.19 |
| 5,866,987 | A | | 2/1999 | Wut | 315/119 |
| 5,894,201 | A | | 4/1999 | Wong | 315/241 S |
| 5,903,103 | A | | 5/1999 | Garner | 315/76 |
| 5,909,088 | A | | 6/1999 | Wut | 315/200 A |
| 5,921,653 | A | | 7/1999 | Chien | 362/103 |
| 5,932,975 | A | | 8/1999 | Wut | 315/119 |
| 5,934,784 | A | | 8/1999 | Dion | 362/103 |
| 5,945,911 | A | | 8/1999 | Healy et al. | 340/573.1 |
| 5,955,712 | A | | 9/1999 | Zakutin | 200/61.48 |
| 5,957,541 | A | | 9/1999 | Seigler | 301/5.3 |
| 5,969,311 | A | | 10/1999 | Mader | 200/61.49 |
| 5,969,479 | A | * | 10/1999 | Wong | 315/200 A |
| 6,012,822 | A | | 1/2000 | Robinson | 362/103 |
| 6,060,673 | A | | 5/2000 | Jackman | 200/61.45 R |
| 6,065,851 | A | | 5/2000 | So | 362/103 |
| 6,071,166 | A | * | 6/2000 | Lebensfeld et al. | 446/175 |
| 6,094,141 | A | | 7/2000 | Tsai | 340/573.1 |
| 6,099,185 | A | | 8/2000 | Huang et al. | 401/195 |
| 6,104,140 | A | | 8/2000 | Wut et al. | 315/200 A |
| 6,106,132 | A | | 8/2000 | Chen | 362/118 |

| | | | | |
|---|---|---|---|---|
| 6,112,437 | A | 9/2000 | Lovitt | 36/137 |
| 6,129,473 | A | 10/2000 | Shu | 401/195 |
| 6,145,999 | A | 11/2000 | Van Derlande | 362/252 |
| 6,158,871 | A | 12/2000 | Geddes et al. | 362/118 |
| 6,164,794 | A | 12/2000 | Rodgers | 362/103 |
| 6,170,968 | B1 | 1/2001 | Caswell | 362/469 |
| 6,241,371 | B1 | 6/2001 | Dai | 362/500 |
| 6,246,186 | B1 | 6/2001 | Nieberger | 315/291 |
| 6,261,018 | B1 | 7/2001 | Chen | 401/195 |
| 6,280,045 | B1 | 8/2001 | Anteby et al. | 362/103 |
| 6,332,692 | B1 | 12/2001 | McCurdy | 362/103 |
| 6,348,766 | B1 | 2/2002 | Ohishi et al. | 315/200 A |
| 6,354,712 | B1 | 3/2002 | Anteby | 362/103 |
| 6,360,615 | B1 | 3/2002 | Smela | 73/862.474 |
| 6,398,395 | B1 | 6/2002 | Hyun | 362/500 |
| 6,408,545 | B1 | 6/2002 | Song | 36/127 |
| 6,416,327 | B1 | 7/2002 | Wittenbecher | 434/247 |
| 6,525,487 | B1 | 2/2003 | Wei | 315/200 A |
| 6,619,812 | B1 | 9/2003 | Rapisarda | 362/103 |
| 2003/0137852 | A1 | 7/2003 | Rapsisarda | 362/570 |
| 2003/0185019 | A1 | 10/2003 | Rogers et al. | 362/545 |
| 2004/0251837 | A1 | 12/2004 | Leung et al. | 315/76 |
| 2004/0264176 | A1* | 12/2004 | Vanderschuit | 362/106 |
| 2005/0017863 | A1* | 1/2005 | Woods | 340/539.1 |
| 2005/0035728 | A1* | 2/2005 | Schanberger et al. | 315/291 |
| 2005/0141218 | A1* | 6/2005 | Tsai | 362/227 |

FOREIGN PATENT DOCUMENTS

| | | | |
|---|---|---|---|
| CN | 2084731 | U | 9/1991 |
| CN | 2096471 | U | 2/1992 |
| CN | 2096910 | U | 2/1992 |
| CN | 2131725 | Y | 5/1993 |
| CN | 2167582 | Y | 6/1994 |
| CN | 2198731 | Y | 5/1995 |
| CN | 2448567 | Y | 9/2001 |
| EP | 0 121 026 | A1 | 10/1984 |
| EP | 0 335 467 | B1 | 6/1993 |
| EP | 0 427 920 | B1 | 6/1994 |
| EP | 0 888 034 | A | 12/1998 |
| EP | 0 888 034 | A2 | 12/1998 |
| EP | 0 773 529 | B1 | 8/1999 |
| EP | 0 888 034 | A3 | 11/1999 |
| GB | 2 361 624 | A | 10/2001 |
| JP | 354-133766 | A | 10/1979 |
| JP | 355-080376 | A | 6/1980 |
| JP | 54-133766 | A | 10/1989 |
| JP | 405-021188 | A | 1/1993 |
| JP | 7-112596 | | 5/1995 |
| JP | 10-232635 | | 9/1998 |
| JP | 10-309889 | | 11/1998 |
| JP | 11-7802 | | 1/1999 |
| JP | 2000-37989 | A | 2/2000 |
| WO | WO 93/11681 | A1 | 6/1993 |

* cited by examiner

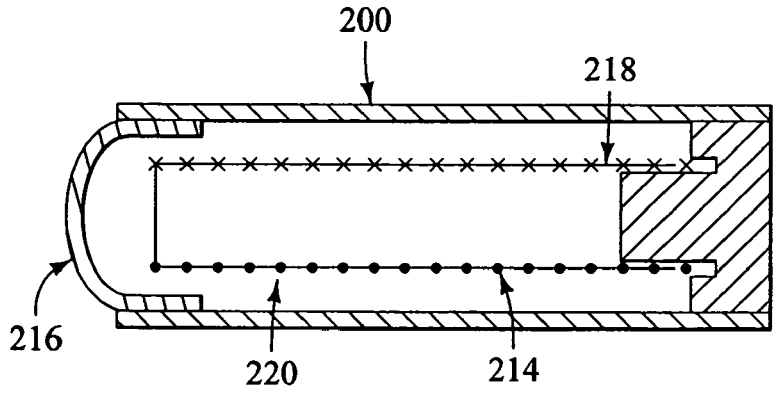
FIG. 2A
FIG. 2B
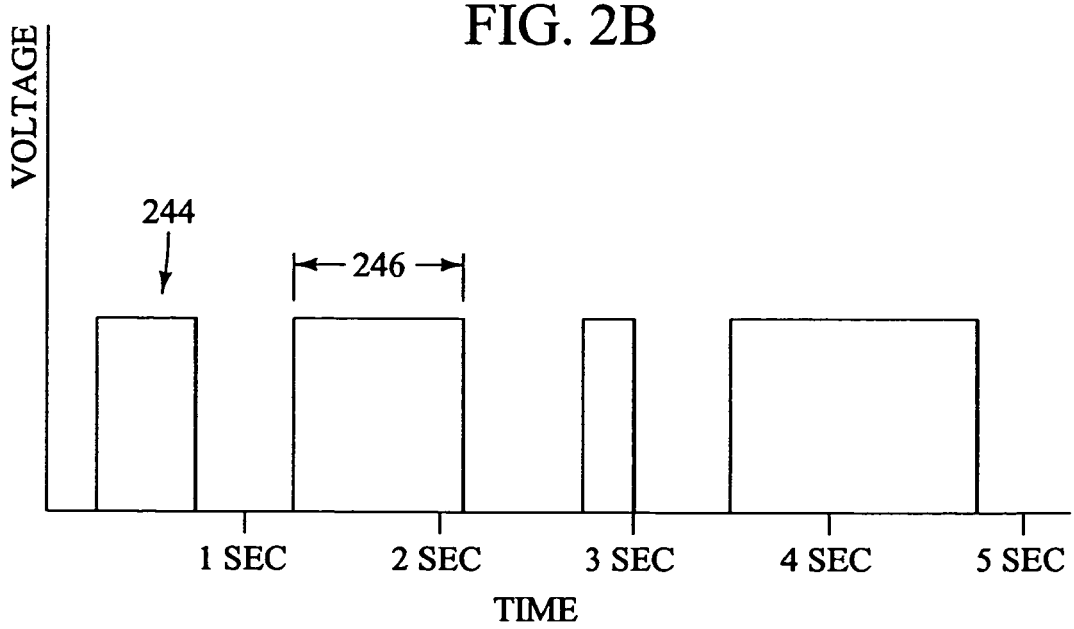

FREQUENCY CONTROLLED LIGHTING SYSTEM

RELATED APPLICATIONS

The present patent document is a continuation-in-part of application Ser. No. 10/662,796 filed on Sep. 15, 2003, which is hereby incorporated herein in its entirety by this reference.

FIELD OF THE INVENTION

The present invention relates generally to clothing and accessories, and more particularly to an improved system for illuminating devices incorporated into clothing and accessories.

BACKGROUND

Lighting systems have been incorporated into footwear, generating distinctive flashing lights when a person wearing the footwear walks or runs. These systems generally have an inertia switch, so that when the heel of a runner strikes the pavement, the switch activates the flashing light system. The resulting light flashes are useful in identifying the runner, or at least the presence of the runner, due to the easy-to-see nature of the flashing lights.

These lighting systems, however, suffer from a number of deficiencies. There is typically no on-off switch for the lighting system, and thus the system is "on" all the time, draining the power source, which is typically a small battery. Even if the only portion of the system that is operating is an oscillator or timer, the power drain over time is cumulative, this leading to shorter-than-desirable battery life. It would be desirable to have some other means for turning the lighting system on or off, especially through the use of an external motion.

Another deficiency is that many flashing or intermittent light systems only have one light pattern. While one light pattern makes the user more visible, there is no provision for varying or making the pattern interesting dependent on the type of movement of the user. It would be desirable to have some system for activating different light patterns depending on the type of movement of the user.

Yet another deficiency in current lighting systems is that most systems use a single integrated circuit to implement all the functions of the system. Due to the fact that an integrated circuit normally has only one cutoff operation voltage, when the voltage level of the power source for the system descends below the cutoff operation voltage over time, the lighting system stops working all together. It would be desirable to have a system which implements multiple integrated circuits so that, as the voltage level of the power source of the system decreases over time, only those functions which require a large voltage level will cease to operate while the functions which require a small voltage level will continue to operate. This ability to adapt to the decreasing voltage level could extend the operating life of the system.

Another deficiency is that many components that currently make up lighting systems are made with toxic components that do not meet environmental regulations of many countries. Due to the fact lighting systems are incorporated in footwear, it is especially desirable for lighting systems to be made of components that are non-toxic, and therefore not harmful to those wearing the shoes. Additionally, when shoes become worn out and are discarded, it is desirable for the components in the shoes to be made of materials that will not be harmful to the environment. Therefore, it is desirable to have a lighting system for footwear made of non-toxic components that meet environmental regulations of many countries. The present invention is directed at correcting these deficiencies in the prior art.

BRIEF SUMMARY

One embodiment of the invention provides a frequency controlled lighting system which includes a motion switch, a controller, and lighting elements. Generally, the motion switch generates an activation signal in response to movement of the motion switch which indicates at least one of the duration and frequency of electrical engagement within the motion switch. The controller detects the activation signal produced by the motion switch and illuminates the lighting elements in one or more predetermined illumination patterns dependant on the duration and frequency of electrical engagement within the motion switch.

Another embodiment of the invention provides a method for illuminating a series of lighting elements. First an activation signal is created based on the movement of a motion switch. Based on the activation signal, a duration of electrical engagement and a frequency of electrical engagement within the motion switch for a period of time is determined. In response to activation of the motion switch, at least one of a series of lighting elements is illuminated. Finally, the duration of electrical engagement is compared to a predetermined duration level to determine an illumination pattern for the series of lighting elements and the frequency of electrical engagement within the motion switch is compared to a predetermined frequency threshold to adjust the illumination pattern of the series of lighting elements.

Yet another embodiment of the invention provides another frequency controlled lighting system including a motion switch, a controller, and lighting elements. The motion switch generates an activation signal in response to movement of the motion switch due to the electrical engagement of a free end of a spring and a metal contact. The controller detects the activation signal and a signal analysis system within the controller analyzes the activation signal to command a pattern generator to illuminate the lighting elements in one or more predetermined lighting patterns.

Another embodiment of the invention provides another frequency controlled lighting system including at least one power source, at least one motion switch, an integrated circuit functioning as a controller, an integrated circuit functioning as a sound generator, and lighting elements. Generally, the motion switch generates an activation signal in response to electrical engagement within the motion switch which indicates at least one of the duration and frequency of electrical engagement within the motion switch. The integrated circuit functioning as the controller detects the activation signal produced by the motion switch and illuminates the lighting elements in one or more predetermined illumination patterns, or actuates the integrated circuit functioning as the sound generator to generate one or more sounds, dependant on the duration and frequency of electrical engagement within the motion switch. The cutoff operating voltage of the sound generator is higher than the cutoff operating voltage of the controller so that as the voltage level of the power source decreases over time, the controller may continue to operate independent of the sound generator while the voltage level of the power source is above the cutoff operating voltage of the controller but below the cutoff operating voltage of the sound generator.

BRIEF DESCRIPTION OF THE DRAWINGS

FIG. 2*a* is a schematic of a spring motion switch;

FIG. 2*b* is a diagram of an activation signal generated within the motion switch of FIG. 2*a;*

DETAILED DESCRIPTION OF THE DRAWINGS AND THE PRESENTLY PREFERRED EMBODIMENTS

Figure 1:
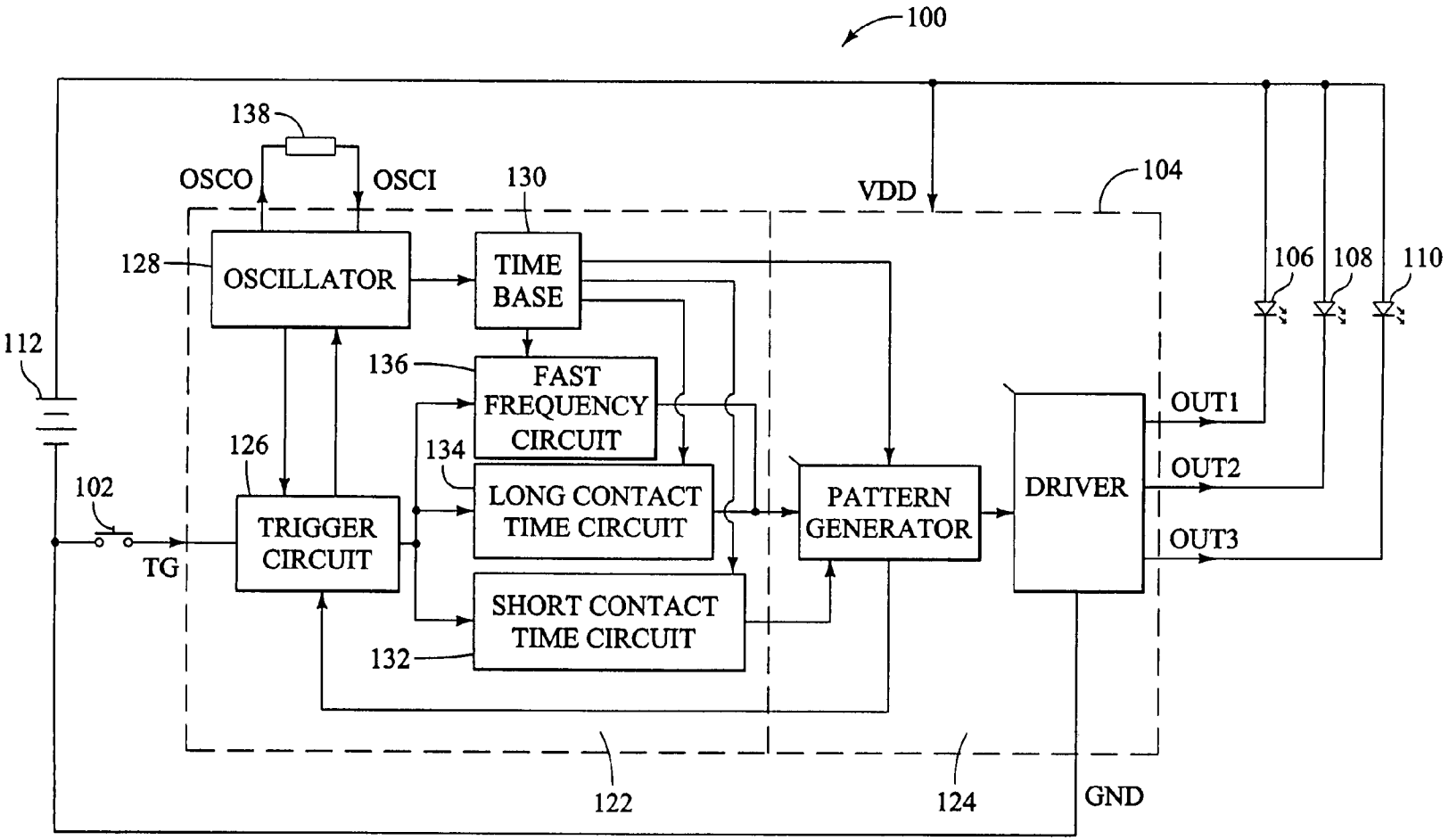
FIG. 1 is a block diagram of a frequency controlled lighting system in accordance with one embodiment of the current invention.

As shown in FIG. 1, a frequency controlled lighting system 100 generally includes a motion switch 102, a controller 104, and a series of lighting elements 106, 108, and 110. In general, movement of the motion switch 102 triggers the controller 104. The controller 104 analyzes the movement of the motion switch 102, and in response to that general movement, illuminates the series of lighting elements 106, 108, and 110 in one or more predetermined patterns. In one exemplary embodiment, the frequency controlled lighting system 100 is incorporated in a shoe or other footwear. The controller 104 and motion switch 102 are contained, for example, in a hollow portion of the shoe sole and the lighting elements 106, 108, 110 are positioned along sides of the shoe for maximum visibility.

Preferably the motion switch 102 is an inertia switch such as a spring motion switch, but any motion switch 102 known in the art can be used. FIG. 2*a* is an exemplary embodiment of a spring motion switch 200 suitable for use in the frequency controlled lighting system 100 of FIG. 1. The spring motion switch 200 is shown in cross section. As shown in FIG. 2*a*, in a preferred embodiment, the spring motion switch 200 includes a spring 214 and a contact 216. The spring 214 is generally made of electrically conductive material such as metal wire wrapped in a cylindrical shape and is positioned within the spring motion switch 200 to have a fixed end 218 and a free end 220. The free end 220 of the spring 214 is positioned proximate the contact 216 so that the free end 220 of the spring 214 electrically engages the contact 216 during movement of the motion switch 200. One suitable spring motion switch 200 including a spring 214 and a contact 216, with a free end 220 of the spring positioned proximate the contact 216 for electrical engagement during movement of the switch 200 is described in U.S. patent application Ser. No. 10/100,621, filed Mar. 18, 2002 and commonly assigned to the owner of the present application, which application is hereby incorporated by reference.

Preferably the spring 214 within the motion switch 200 moves between two general positions. In a first position illustrated in FIG. 2*a*, the free end 220 of the spring 214 is a sufficient distance from the contact 216 so that an electric current cannot pass between the spring 214 and the contact 216, creating an open circuit through the motion switch 200. The spring is normally in the first position when the motion switch 200 is stationary.

In a second position, the free end 220 of the spring 214 bends so that it electrically engages the contact 216, creating a closed circuit in the motion switch 200 between the free end 220 of the spring 214 and the contact 216 so that, if an appropriate bias voltage is applied, an electric current can pass through the motion switch 200. The motion switch 200 is normally in the second position at different points during movement of the motion switch 200.

The periodically closed circuit within the motion switch 200 due to the movement of the free end 220 of spring 214 between the first and second position creates an activation signal. As seen in FIG. 2*b*, the activation signal consists of at least one pulse 244 of voltage or current indicating that the motion switch 200 has been activated. Preferably, the length of the pulse 246 is directly related to the duration of electrical engagement between the free end 220 of the spring 214 and the contact 216. Additionally, the activation signal preferably represents the frequency of electrical engagement by the number of times the free end 220 of the spring 214 electrically engages the contact 216 in a period of time. For example, in FIG. 2*b* there are four pulses in 5 seconds. This represents the free end 220 of the spring 214 electrically engaging the contact 216 four times within 5 seconds. It is this activation signal that the motion switch 200 provides to the controller 104 when the motion switch 200 is activated. The frequency of electrical engagement directly relates to the frequency of external motion of the user. Preferably, the frequency of electrical engagement is re-calibrated by the controller to determine an accurate motion frequency using a factor dependant on the type of motion switch used. For example, if a one-way motion switch is used, the controller uses a factor of one so that the frequency of electrical engagement is the frequency of external motion of the user. If a two-way motion switch is used, the controller uses a factor of two so that the frequency of electrical engagement is dived by two to determine an accurate frequency of external motion of the user.

A one-way motion switch is a motion switch where the contact 216 is positioned such that electrical engagement with the free end 220 of the spring 214 is only possible when the free end 220 of the spring 214 travels in one direction of movement. A two-way motion switch is a motion switch where the contact 216 is positioned such that electrical engagement with the free end 220 of the spring 214 is possible when the free end 220 of the spring 214 travels in either of two directions of movement.

In additional embodiments, the motion switch 102 (FIG. 1) could also be a magnetic reed switch (not shown) or a metal ball motion switch (not shown). If a magnetic reed switch is used, at least two magnetic contacts having a free end and a fixed end are positioned proximate to each other so that the free ends of the metal contacts electrically engage due to the magnetic flux of a magnet when the magnet is placed near the free ends of the two magnetic contacts.

Preferably, the magnet is placed in a specially designed housing to hold the magnet. In one embodiment, an internal magnet is placed within the shoe to sense motion of the switch. Typically, the housing holding the interior magnet defines a space to allow the magnet to move along the axis of the housing during movement. In another embodiment, an external magnet is placed outside the shoe. Preferably, the external magnet is fixed in a specially designed plastic housing to allow the user to move the magnet near the magnetic reed switch to cause an electrical engagement within the magnetic reed switch which generates a signal to actuate the integrated circuits. The magnetic reed switch generates a similar activation signal to that of the spring motion switch 102 illustrated in FIG. 2 where current does not normally flow through the magnetic reed switch but when a magnet is periodically placed near the magnetic reed switch, due to periodic electrical engagement of the contacts, an activation signal is created having properties of duration of electrical engagement and frequency of electrical engagement for a period of time. It should also be noted that, as will be described below in greater detail in connection with FIG. 3, additional motion switches 342 can be added to the frequency controlled lighting system 300 so that the system 300 operates in response to movement of different parts of an object.

Referring again to FIG. 1, the controller 104 in the illustrated embodiment includes a signal analysis system 122 and a pattern generator 124. In general, the signal analysis system 122 analyzes the activation signal which the controller 104 detects from the motion switch 102. In particular, the signal analysis system 122 preferably determines the duration of electrical engagement within the switch 102 from each pulse in the activation signal, and determines the frequency of electrical engagement of the switch for a given period of time. In response to the duration of each electrical engagement and the frequency of electrical engagement, the signal analysis system 122 commands the pattern generator 124 to illuminate the lighting elements 106, 108, and 110 in one or more predetermined lighting patterns.

In one embodiment, the signal analysis system 122 includes a trigger circuit 126, an oscillator 128, a time-base 130, a short contact circuit 132, a long contact circuit 134, and a fast frequency circuit 136. Initially, the trigger circuit 126 receives the activation signal from the motion switch 102. In response, the trigger circuit 126 actuates the oscillator 128, the short contact circuit 130, the long contact circuit 132, the fast frequency circuit 134, and the pattern generator 136. When activated, the oscillator 128 creates a frequency signal with a time period dependant on an oscillation resistor 138. The oscillator resistor 138 can be modified to any value to adjust the frequency signal. The oscillator 128 passes the frequency signal to the time-base 130, which creates a timing signal dependent on the time period of the frequency signal to control the timing of the short contact circuit 132, long contact circuit 134, fast frequency circuit 136, and pattern generator 124.

At generally the same time that the time-base 130 signals the short contact circuit 132, long contact circuit 134, and fast frequency circuit 136, the trigger circuit 126 passes the activation signal to the short contact circuit 132, long contact circuit 134, and fast frequency circuit 136 for examination of the activation signal. Specifically, the short contact circuit 132 examines each pulse within the activation signal to determine whether the pulse length, and therefore the duration of electrical engagement within the motion switch 102, is less than or equal to a predetermined duration level. The predetermined duration level may be any length of time desired by the frequency controlled lighting system designer, but preferably, the duration level is set to be the same time period as the on-time of an LED during flashing. For example, in one embodiment, the predetermined duration level is set to 16 ms. If the short contact circuit 132 determines that the pulse length is equal to or less than the predetermined duration level, the short contact circuit 132 produces a short contact signal.

The long contact circuit 134 examines each pulse within the activation signal to determine whether the duration of electrical engagement is greater than the predetermined duration level. If the long contact circuit 134 determines that the pulse length is greater than the predetermined duration level, the long contact circuit 134 produces a long contact signal. The predetermined duration of the long contact circuit 134 may be the same as or different from the predetermined duration of the short contact circuit 132.

The fast frequency circuit 136 examines the number of pulses in the activation signal within a period of time. If the fast frequency circuit 136 determines that the number of pulses in the activation signal for the period of time is above a predetermined frequency threshold, the fast frequency circuit produces a fast frequency signal. The fast frequency threshold can be any frequency limit desired by the frequency controlled lighting system designer, but preferably, the fast frequency threshold is between 5 Hz and 3 KHz.

Preferably, the pattern generator 124 creates different types of lighting patterns in response to detecting the short contact signal, long contact signal, and fast frequency signal. The pattern generator 124 can be programmed or arranged to react differently to any of these signals, but preferably, the pattern generator 124 is programmed to illuminate the lighting elements 106, 108, and 110 in one or more different predetermined lighting sequences each time the short contact circuit 132 signals the pattern generator 124. Further, the pattern generator 124 is preferably programmed to interrupt the lighting sequence and illuminate one lighting element when signaled by the long contact circuit 134 or fast frequency circuit 136. Preferably, the pattern generator 124 continues to illuminate the single lighting element until the long contact signal or the fast frequency signal ceases.

Figure 3:
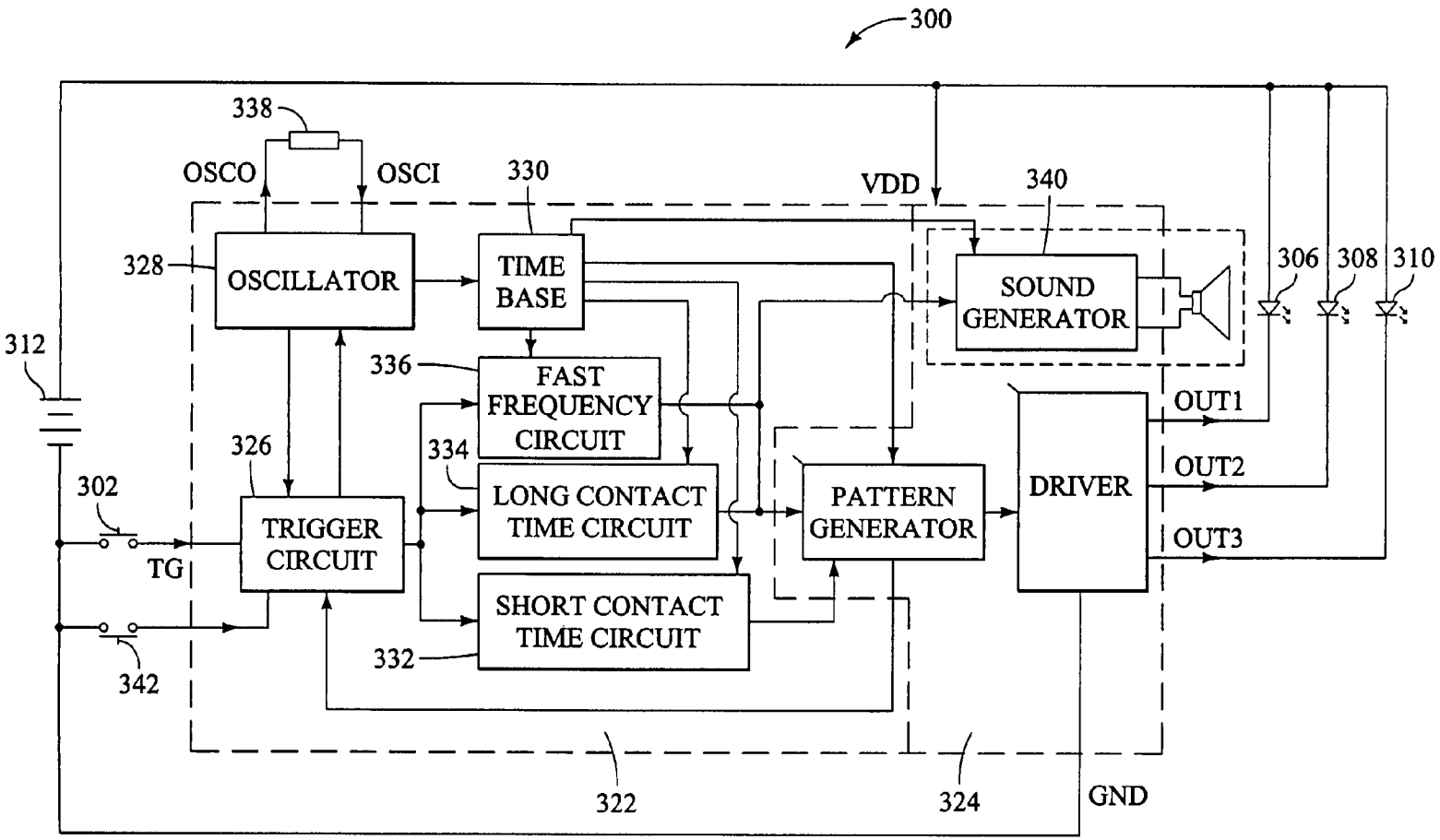
FIG. 3 is a block diagram of a second embodiment of the frequency controlled lighting system which includes a sound generating device.

As seen in FIG. 3, in another embodiment the pattern generator 324 can be programmed to perform functions in addition to illuminating lighting elements 306, 308, and 310 such as actuating a sound generating device 340. The sound generating device 340 can be any sound generating device known in the art such as a speaker generating a voice or music, a transducer, or a simple buzzer. Preferably, a sound generating device 340 is actuated when the pattern generator 324 receives a long contact signal or a fast frequency signal, and the sound generating device 340 continues to operate until the long contact signal or fast frequency signal ceases. Additionally, in embodiments containing multiple motion switches 302, 342, the sound generating device 340 may be programmed so that the sound generating device 340 produces a different sound depending on which motion switch 302, 342 produces an activation signal. Other components of FIG. 3 match the components of FIG. 1.

Figure 4:
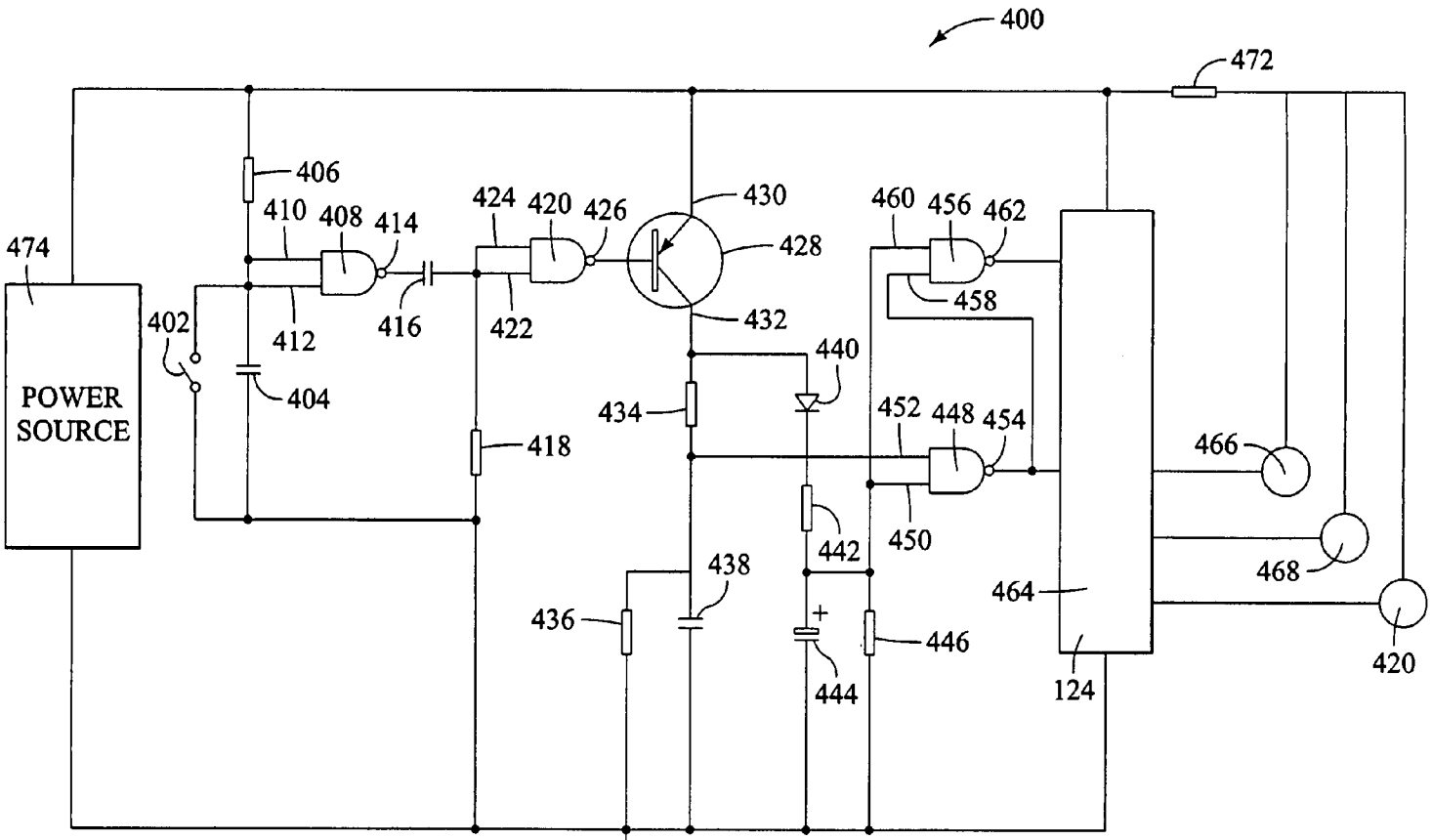
FIG. 4 is a circuit diagram of one embodiment of the frequency controlled lighting system.

An exemplary circuit illustrating one embodiment of a frequency controlled lighting system is shown in FIG. 4. In this embodiment, the trigger circuit 126, oscillator 128, time-base 130, short contact circuit 132, long contact circuit 134, and fast frequency circuit 136 (FIG. 1) are implemented through resistors 406, 418, 434, 436, 442, and 446; capacitors 404, 416, 438, and 444; NAND gates 408, 424, 448, and 456; a diode 440; and a transistor 428. Additionally, the pattern generator 124 is implemented through an integrated circuit 464.

The pattern generator 124 may be any number of integrated circuits suitable for controlling the flashing of the lighting elements 466, 468, and 470 in the system 400. One example of such an integrated circuit, manufactured with CMOS technology for one-time programmable, read-only memory, is Model No. EM78P153S, made by EMC Corp., Taipei, Taiwan. Other examples of integrated circuits include MC14017BCP and CD4107AF, made by many manufacturers; custom or application specific integrated circuits; CMOS circuits, such as a CMOS 8560 circuit; or M1320 and M1389 RC integrated circuits made by MOS-design Semiconductor Corp., Taipei, Taiwan.

Generally, motion switch 402, resistor 406, and capacitor 404 connect to the inputs 410, 412 of NAND gate 408. Resistor 406 connects between the power source 474 and the inputs 410, 412 of NAND gate 408 while the motion switch 402 and capacitor 404 connect between the inputs 410, 412 of NAND gate 408 and ground. The output 414 of NAND gate 408 connects to capacitor 416, which connects to the inputs 422, 424 of NAND gate 420. Resistor 418 also connects between the inputs 410, 412 of NAND gate 408 and ground. The output of NAND gate 420 connects to the base 426 of transistor 428, while the emitter 430 of transistor 428 connects to the power supply 474. The collector of transistor 432 connects to ground via a resistor-capacitor combination consisting of resistor 434, resistor 436, and capacitor 438. The common node between resistor 434, resistor 436, and capacitor 438 additionally connects to input 452 of NAND gate 448.

The collector of transistor 428 also connects to ground via diode 440, resistor 442, and capacitor 444. The common node between resistor 442 and capacitor 444 connects to input 450 of NAND gate 448. Resistor 446 connects between input 450 of NAND gate 446 and ground. Input 460 to NAND gate 456 also connects to input 450 of NAND gate 448 while input 458 to NAND gate 456 connects to the output of NAND gate 448. The outputs to NAND gates 448 and 456 connect to the pattern generator 464, which additionally connects to the power supply 474 and the lighting elements 466, 468, and 470.

Before operation of the frequency controlled lighting system 400, the inputs 410, 412 to NAND gate 408 are biased to a high voltage state. The high inputs at NAND gate 408 result in a low output at NAND gate 408, forcing the inputs of NAND gate 420 to a low voltage state. The low voltage of the inputs 420, 424 to NAND gate 420 result in a high output at the base of transistor 428. Therefore, due to the fact there is not a sufficient voltage drop across the transistor, the transistor 428 does not conduct and no current passes through transistor 428. For this reason, capacitors 438 and 444 do not charge and over time fully dissipate any charge stored in the capacitors over resistor 436 or resistor 446. Thus, input 460 of NAND gate 456 and the inputs of NAND gate 448 are low dictating the output of NAND gate 456 and NAND gate 448 to be at a high state before operation of the frequency controlled lighting system.

During movement of the motion switch 402 in the preferred embodiment, the switch 402 produces a signal as a result of the free end 220 of the spring 214 electrically engaging the metal contact 216. The electrical engagement of the spring 214 and the contact 216 creates a closed circuit, allowing current to flow through the motion switch 402 and force the inputs of NAND gate 408 to change from high to low. The change in voltage state of the inputs to NAND gate 408 results in the output of NAND gate 408, and therefore the inputs of NAND gate 420, to change from low to high. The change in voltage state of the inputs to NAND gate 420 force the output of NAND gate 420 to low.

Since the output of NAND gate 420 is connected to the base of transistor 428, as the base voltage of transistor 428 goes from high to low, transistor 428 begins conducting. As current flows through transistor 428, capacitor 438 begins charging through resistor 434 and discharging through resistor 436. Preferably, resistor 434 is larger than resistors 436 and 442 so that capacitor 438 does not charge to a high enough level to change the voltage state of input terminal 452 of NAND gate 448 from low to high during a short electrical engagement within the motion switch 402.

As current flows through transistor 428, capacitor 444 also charges. Preferably, capacitor 444 charges to a high level, causing input terminal 450 to NAND gate 448 and input terminal 460 to NAND gate 456 to change from low to high. Therefore, due to the fact input terminal 452 to NAND gate 448 remains low and input terminal 450 to NAND gate 448 changes from low to high, the output of NAND gate 448 remains high. Further, since input terminal 460 to NAND gate 456 changes from low to high and input terminal 458 to NAND gate 456 remains high, the output of NAND gate 456 changes from high to low. This change in output from NAND gate 456 signals the pattern generator 464 to actuate the lighting elements 466, 468, and 470 in a predetermined flashing pattern. The output of NAND gate 448 at a high voltage state while the output of NAND gate 456 is at a low voltage state is the short contact signal.

Preferably, the pattern generator 464 is programmed to illuminate the lighting elements 466, 468, and 470 in a different pattern each time it receives the short contact signal. For example, if the lighting elements 466, 468, and 470 are outputs 1, 2, and 3, the first time the pattern generator 464 receives the short contact signal it illuminates the lights in the sequence 1-2-3-1-2-3-1-2-3 where the number 1, 2, and 3 refer to LEDs 466, 468, and 470 respectively. The second time the pattern generator 464 receives the short contact signal it illuminates the lights in the sequence 2-3-1-2-3-1-2-3-1. The third time the pattern generator 464 receives the short contact signal it illuminates the lights in the sequence 3-1-2-3-1-2-3-1-2. The pattern generator 464 continues illuminating the lighting elements 466, 468, and 470 in different patterns each time it receives a short contact signal.

During production of the predetermined flashing pattern, if the motion switch 402 closes for a long duration such as 16 ms, or the motion switches closes a large number of times in a short time period, such as five times in one second, the inputs to NAND gate 408 change from high to low for a long period of time, resulting in the output of NAND gate 408 changing from low to high for a long period of time. Due to the change in output of NAND gate 408, the inputs to NAND gate 420 again change from low to high, causing the output to NAND gate 420 to change to low. Since the base of transistor 428 is connected to the output of NAND gate 420, transistor 428 starts conducting. Transistor 428 conducts for a large period of time due to the long duration of electrical engagement within the motion switch or the high frequency of electrical engagement within the switch 402. Therefore, capacitors 438 and 444, which charge when current flows through transistor 428, are able to store a relatively high charge and establish a relatively high voltage drop between ground and input 452 of NAND gate 448. The high charge of capacitor 438 forces input terminal 452 of NAND gate 148 to high. Additionally, the high charge of capacitor 444 forces input terminal 450 to NAND gate 448 and input terminal 460 to NAND gate 456 to high.

The change in the voltage state of the input terminals to NAND gate 448 drives the output of NAND gate 448 to low. Due to this change in the output of NAND gate 448, input terminal 458 to NAND gate 456 also changes from high to low, resulting in the output of NAND gate 456 changing to high. The change in outputs of NAND gates 448 and 456 signals the pattern generator 464 to freeze any current flashing pattern of the pattern generator 464. Preferably, the output of the pattern generator 464 is frozen until capacitors 438 and 444 discharge to a low enough level that NAND gates 448 and 456 return to their standby state of high. The output of NAND gate 448 being at a low voltage state while the output of NAND gate 456 is at a high voltage state is the long contact signal or the fast frequency signal.

Figure 5:
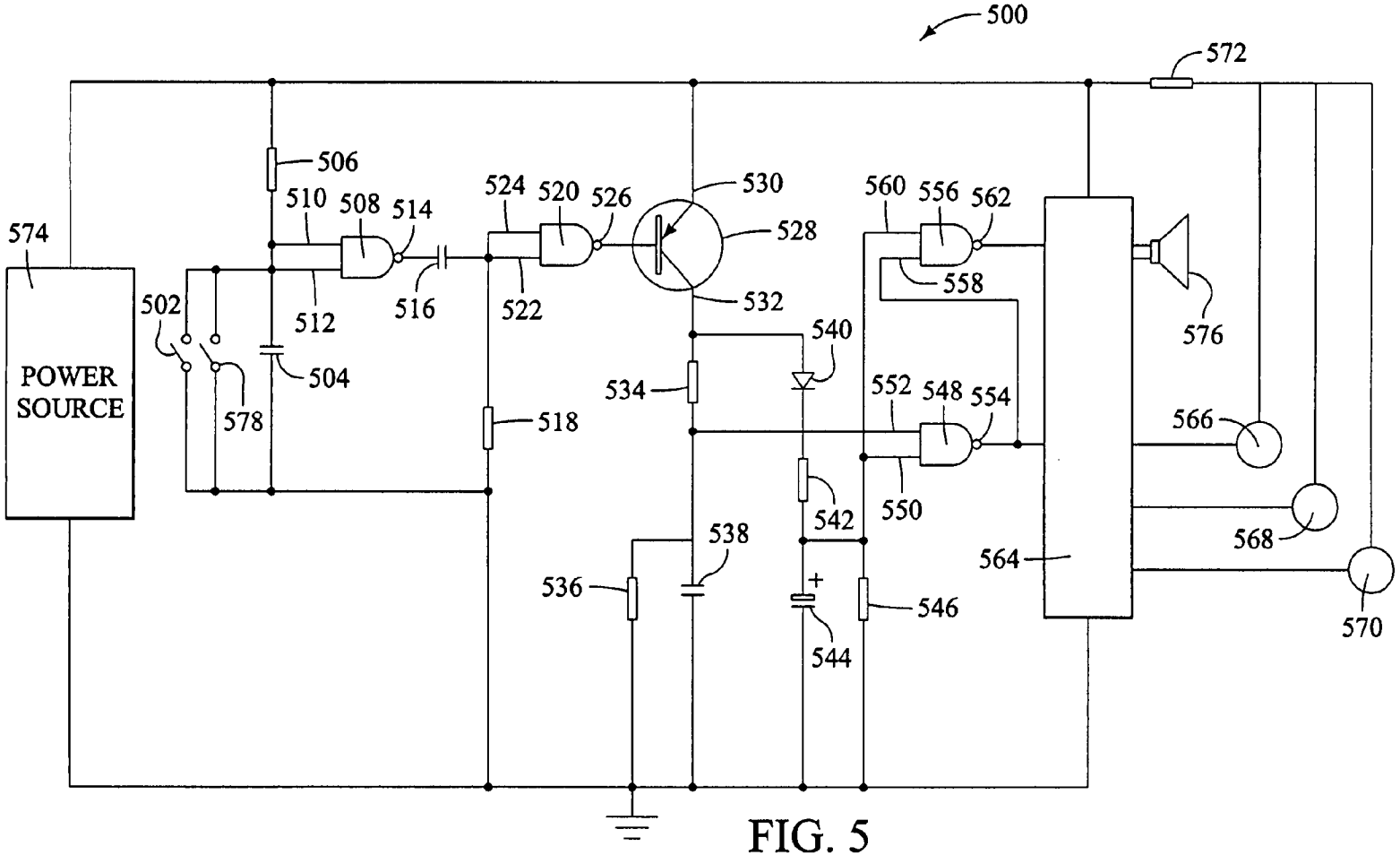
FIG. 5 is a circuit diagram of another embodiment of the frequency controlled lighting system which includes a sound generating device.

In another embodiment, the circuit shown in FIG. 4 can be modified with a sound generating device 576 as shown in FIG. 5. In this embodiment, the pattern generator 564 actuates the sound generating device 576 when the pattern generator 564 receives a long contact signal or a fast frequency signal. The sounds generating device 576 may include any suitable combination of circuitry to respond to actuating signals from the pattern generator 564 by producing sound. The sound generating device 576 may also include a speaker, transducer or other electromechanical device for producing sound. Preferably, the sound generating device continues to produce sound until the long contact signal or fast frequency signal ceases.

Figure 6:
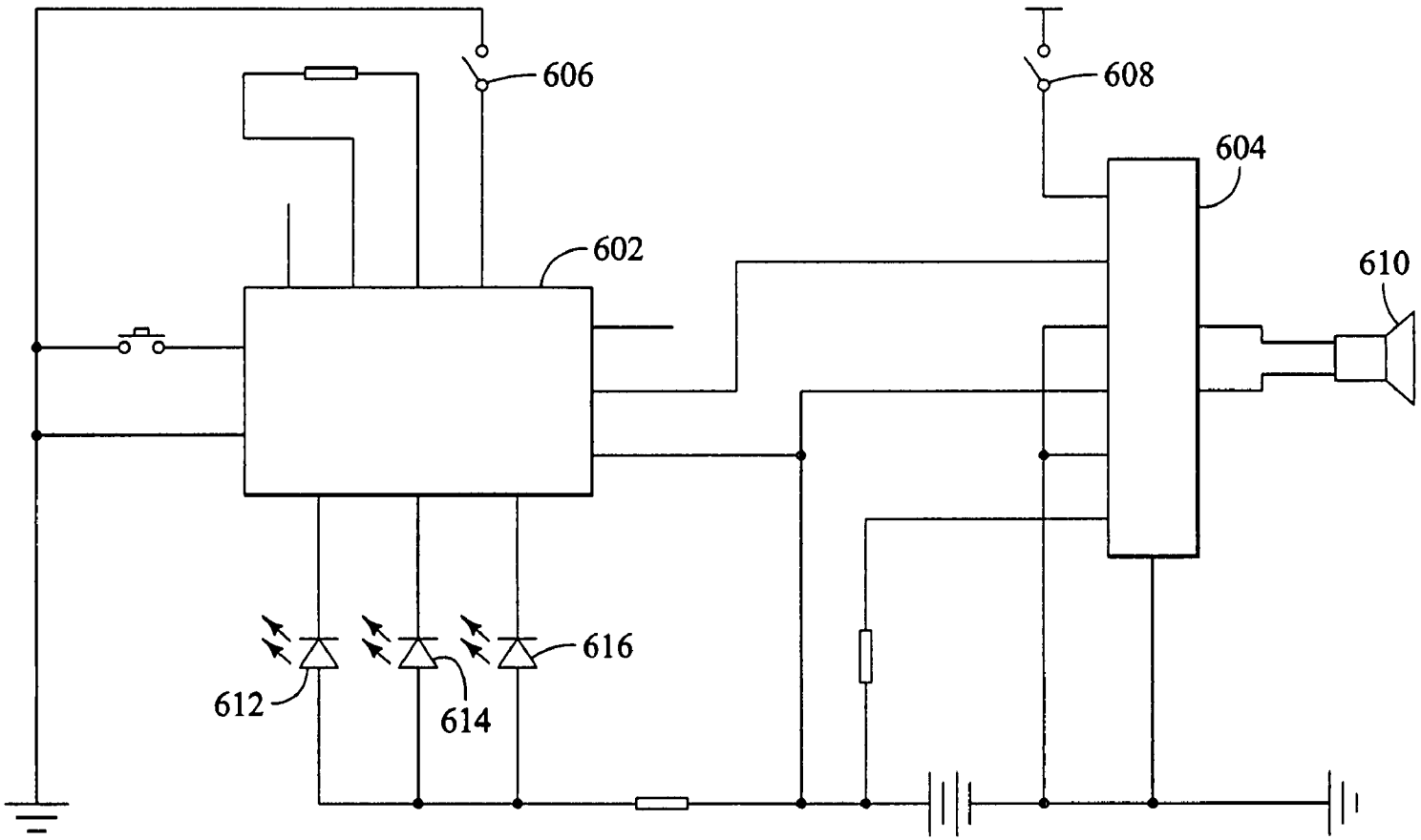
FIG. 6 is a circuit diagram of another embodiment of the frequency controlled lighting system which includes a spring motion switch and a magnetic reed switch.

Another embodiment of the invention having a sound generating device is shown in FIG. 6. The frequency controlled lighting system of FIG. 6 generally includes a first integrated circuit 602, a second integrated circuit 604, a spring motion switch 606, a magnetic reed motion switch 608, a sound generating device 610, and a series of light generating elements 612, 614, 616. In general, the spring motion switch 606 is electrically coupled with the first integrated circuit 602 such that when there is movement in the spring motion switch 606, an activation signal is passed to the first integrated circuit 602. Additionally, the series of light generating elements 612, 614, 616 are electrically coupled with the first integrated circuit 602 such that the first integrated circuit 602 can actuate the series of lighting elements 612, 614, 616 in a predetermined pattern. The first integrated circuit 602 is also electrically coupled with the second integrated circuit 604 such that status signals may be passed between the two integrated circuits.

The magnetic reed motion switch 608 is electrically coupled with the second integrated circuit 604 such that when a magnet actuates the magnetic reed switch 608, an activation signal is passed to the second integrated circuit 604. The sound generating device 610 is also electrically coupled with the second integrated circuit 604 such that the second integrated circuit 604 may actuate the sound generating device 610 to produce a sound.

During operation, when there is movement in the spring motion switch 606, an activation signal is sent to the first integrated circuit 602. In response to the activation signal from the spring motion switch 606, the first integrated circuit 602 actuates the series of light generating elements 612, 614, 616 in one or more different lighting patterns. Alternatively, during operation, when a magnet actuates the magnetic reed switch 608, an activation signal is sent to the second integrated circuit 604. In response to the activation signal from the magnetic reed switch 608, the second integrated circuit 604 actuates the sound generating device 610 to produce one or more different sound patterns.

Preferably, while the first integrated circuit 602 is actuating the light generating elements 612, 614, 616 or while the second integrated circuit 604 is actuating the sound generating device 610, if there is an electrical engagement in the spring motion switch 606 or the magnetic reed switch 608 for a period of time longer than a predetermined duration level, the first integrated circuit 602 will interrupt the flashing pattern of the light generating elements 612, 614, 616 and the second integrated circuit 604 will interrupt the sound pattern from the sound generating device 610. Additionally, while the first integrated circuit 602 is actuating the light generating elements 612, 614, 616 or while the second integrated circuit 604 is actuating the sound generating device 610, if the number of electrical engagements within the spring motion switch 606 or the magnetic reed switch 608 is more than a predetermined frequency threshold, the first integrated circuit 602 will interrupt the flashing pattern of the light generating elements 612, 614, 616 and the second integrated circuit 604 will interrupt the sound pattern from the sound generating device 610.

Figure 7:
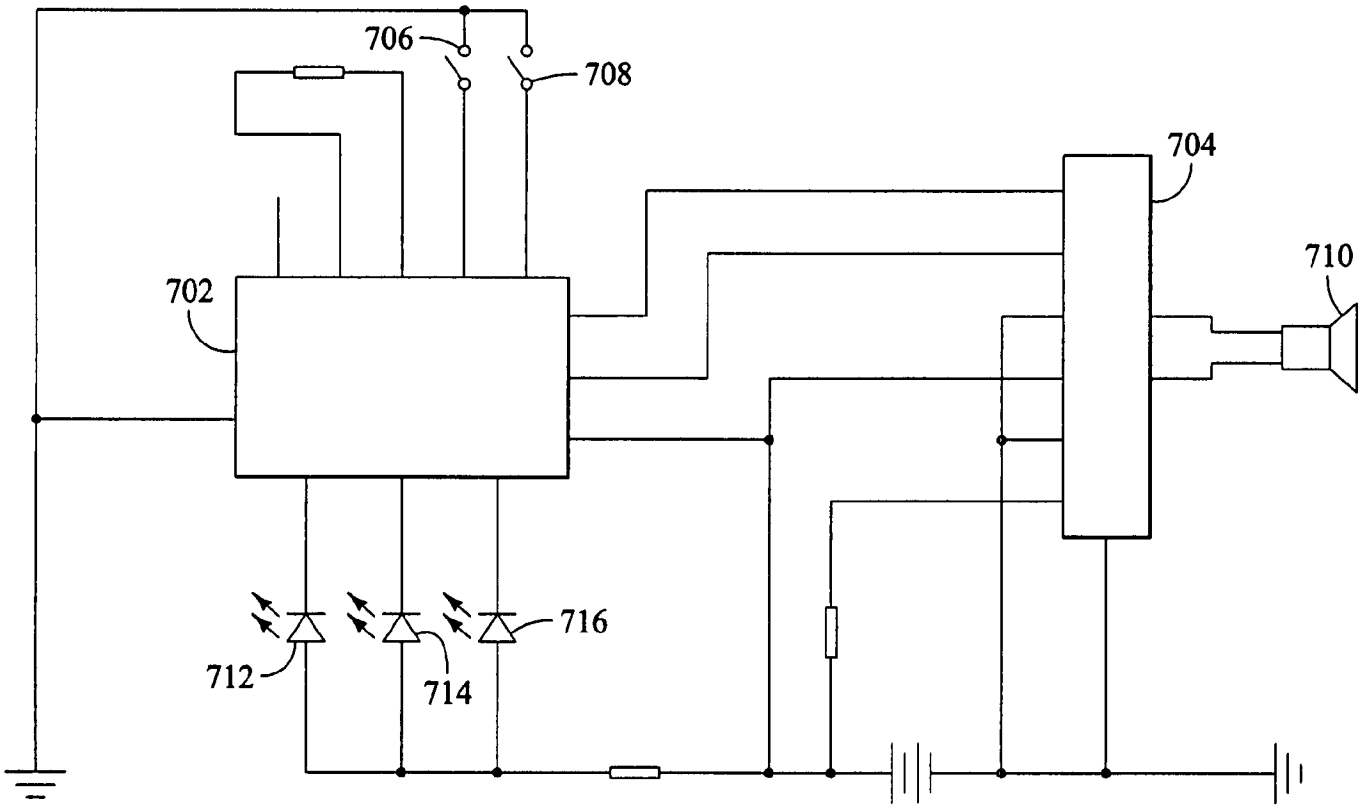
FIG. 7 is a circuit diagram of another embodiment of the frequency controlled lighting system which includes a spring motion switch and a magnetic reed switch.

Yet another embodiment of the invention having a sound generating device is shown in FIG. 7. The frequency controlled lighting system of FIG. 7 generally includes a first integrated circuit 702, a second integrated circuit 704, a spring motion switch 706, a magnetic reed switch 708, a sound generating device 710, and a series of light generating elements 712, 714, 716. In general, the spring motion switch 706 and the magnetic reed switch 708 are electrically coupled with the first integrated circuit 702 such that when there is movement in the spring motion switch 706 or a magnet actuates the magnetic reed switch 708, an activation signal is passed to the first integrated circuit 702. Additionally, the series of light generating elements 712, 714, 716 are electrically coupled with the first integrated circuit 702 such that the first integrated circuit 702 can actuate the series of lighting elements in a predetermined pattern. The first integrated circuit 702 is also electrically coupled with the second integrated circuit 704 such that status signals may be passed between the two integrated circuits. Further, the sound generating device 710 is electrically coupled with the second integrated circuit 704 such that the second integrated circuit 704 may actuate the sound generating device 710 to produce a sound.

During operation, when there is movement in the spring motion switch 706, an activation signal is sent to the first integrated circuit 702. In response to the activation signal from the spring motion switch 706, the first integrated circuit 702 actuates the series of light generating elements 712, 714, 716 in one or more different lighting patterns. Alternatively, during operation, when a magnet actuates the magnetic reed switch 708, an activation signal is sent to the first integrated circuit 702. In response to the activation signal from the magnetic reed switch 708, the first integrated circuit 702 sends a signal to the second integrated circuit 704 such that the second integrated circuit 704 actuates the sound generating device 710 to produce one or more different sound patterns until the activation signal from the magnetic reed switch 708 ceases. Additionally, when the first integrated circuit 702 received an activation signal from the magnetic reed switch 708, the first integrated circuit 702 actuates at least one of the light generating elements 712, 714, 716.

Preferably, while the first integrated circuit 702 is actuating the light generating elements 712, 714, 716, if there is an electrical engagement in the spring motion switch 706 or the magnetic reed motion switch 708 for a period of time longer than a predetermined duration level, the first integrated circuit 702 will interrupt the flashing pattern of the light generating elements 712, 714, 716. Additionally, while the first integrated circuit 702 is actuating the light generating elements 712, 714, 716, if the number of electrical engagements within the spring motion switch 706 or the magnetic reed motion switch 708 for a period of time is more than a predetermined frequency threshold, the first integrated circuit 702 will interrupt the flashing pattern of the light generating elements 712, 714, 716.

Figure 8:
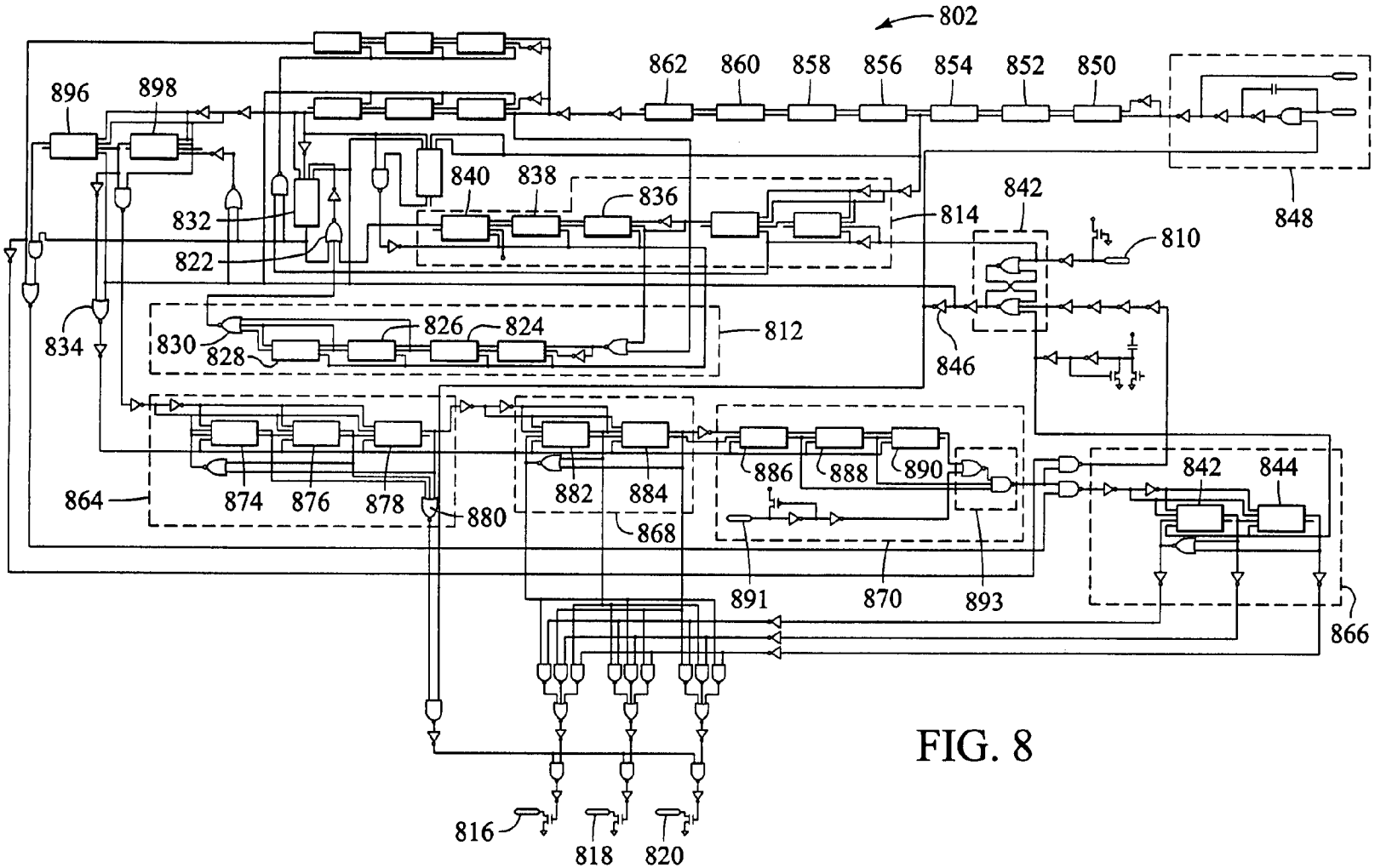
FIG. 8 is a circuit diagram of another embodiment of the frequency controlled lighting system implemented by a CMOS circuit.

Another embodiment of one aspect of the invention is a CMOS circuit 802 shown in FIG. 8. The CMOS circuit 802 includes flip-flops, logic gates, capacitors, and transistors. In general, the CMOS circuit 802 includes three stages 804, 806, and 808. The first stage 804 receives the activation signal generated by the motion switch 810. The second stage 806 analyzes the activation signal. Finally, the third stage 808 illuminates the LEDs 816, 818, and 820. In general, the first stage 804 is connected to the second stage 806 so that the activation signal passes to the long duration circuit 812 and the fast frequency circuit 814 of the second stage 806. The output of the long duration circuit 812 and the fast frequency circuit 814 are passed to NOR gate 822, which signals the third stage 808 if a long duration signal or a fast frequency signal is created. If the third stage 808 does not detect this indication from NOR gate 822 after the activation signal triggers the system 800, the third stage 808 creates a lighting pattern to illuminate the LEDs 816, 818, and 820.

Preferably, the first stage 804 generally includes the motion switch 810, an RS flip-flop 842, at least one NOR gate 846, an RC oscillating circuit 848, and a series of flip-flops 850, 852, 854, 856, 858, 860, and 862. In general, the RS flip-flop 842 is connected to the motion switch 810 such that when there is movement in the motion switch 810, the output of the RS flip-flop 842 changes to high. The change in output of the RS flip-flop 842 causes NOR gate 846 to change voltage state, thereby causing the RC oscillating circuit 848 to begin producing a periodic signal. The signal may have any frequency but preferably the signal has a frequency of 64 kHz.

The periodic signal from RC oscillating circuit 848 passes to flip-flops 850, 852, 854, 856, 858, 860, and 862. Preferably, flip-flops 850, 852, 854, 856, 858, 860, and 862 are connected in series to count down the periodic signal produced by RC oscillating circuit 848. As the periodic signal is counted down the series of flip-flops, the signal passes to various parts of the CMOS circuit 802 to act as a clock.

The second stage 806 acts to analyze the activation signal from the motion switch 810 and generally includes a long duration circuit 812 and a fast frequency circuit 814. Preferably, the long duration circuit 812 includes at least three flip-flops 824, 826, and 828 connected in series and configured to track the duration of electrical engagement represented in the activation signal. Each output of flip-flops 824, 826, and 828 connect to a separate input of three-input NOR gate 830. Therefore, when all three inputs to NOR gate 830 are low, indicating electrical engagement within the motion switch at consecutive periods of time, the output of NOR gate 830 changes to high.

Since the output of NOR gate 830 connects to one of the inputs of NOR gate 822, the change in output of NOR gate 830 drives the output of NOR gate 822 to low. This change in voltage state of the output of NOR gate 822 changes the output of flip-flop 832, which changes the output of NAND gate 834 to low. The output of NAND gate 834 changing to low signals the third stage 808 to freeze any flashing pattern.

Preferably, the fast frequency circuit 814 generally includes at least three flip-flops 836, 838, and 840, which are configured to track the frequency of electrical engagement in the motion switch 810. In general, the at least three flip-flops 836, 838, and 840 are cleared whenever the frequency of electrical engagement is below a predetermined threshold. If flip-flops 836, 838, and 840 are not cleared within a given number of clock cycles, flip-flop 840 outputs a high signal. Due to the fact that the output of flip-flop 840 connects to one of the inputs of NOR gate 822, the output of NOR gate 822 changes to low when the output of flip-flop 840 is high. As discussed with respect to the long duration signal, when the output of NOR gate 822 changes to low, the output of flip-flop 832 changes to high and the output of NAND gate 834 changes to low, again signaling the third stage 808 to freeze any flashing pattern.

The third stage 808 generally includes a number of circuits which control the flashing patterns of LEDs 816, 818, and 820. Preferably, the third stage 808 includes a single illumination control 864, a starting LED control 866, a sequential lighting control 868, a short duration flashing control 870, and a long duration or fast frequency flashing control.

The single illumination control 864 operates to illuminate a single LED during illumination patterns. This governs the light on time and light off time of the LEDs. The single illumination control 864 generally includes at least three flip-flops, 874, 876, and 878, and a NOR gate 880. In general, flip-flops 874, 876, and 878 are configured to output a control signal cycling through "000", "100", "110", "011", and "001." The outputs of flip-flops 874, 876, and 878 each connect to a separate input of NOR gate 880 so that NOR gate 880 only generates a high signal when each flip-flop outputs a low signal. The output of NOR gate 880 connects to the circuitry activating LEDs 816, 818, and 820 such that any LED can only be illuminated when the output of NOR gate 880 is high. Therefore, an LED can only illuminate every fifth clock cycle.

The starting LED control 866 operates to illuminate a different LED at the beginning of a flashing pattern in response to an electrical engagement in the motion switch 810 which is less than the predetermine duration level. The starting LED control 866 generally includes at least two flip-flops, 892 and 894. Flip-flops 892 and 894 are configured to output a control signal cycling through "00", "10" and "01." Preferably, flip-flops 892 and 894 operate within the CMOS circuit 802 to cycle to a new control signal state each time a short electrical engagement within the motion switch 810 is detected. Therefore, the signal from the starting LED control 866 will never be the same for two consecutive short electrical engagements within the motion switch 810.

The outputs of the starting LED control 866 is coupled to the circuitry activating LEDs 816, 818, and 820 such that a different LED illuminates at the beginning of an illumination pattern depending on the state of the control signal from the starting LED control 866. Preferably, LED 816 illuminates first in an illumination pattern when the control signal from the starting LED control 866 is "00;" LED 818 illuminates first in an illumination pattern when the control signal from the starting LED control 866 is "10;" and LED 820 illuminates first in an illumination pattern when the control signal from the starting LED control 866 is "01".

The sequential lighting control 868 operates to illuminate LEDs 816, 818, and 820 in a sequential flashing pattern. In general, the sequential lighting control 868 includes at least two flip-flops, 882 and 884. Preferably, flip-flops 882 and 884 are configured to output a control signal cycling through "00", "10" and "01." The sequential lighting control 868 preferably cooperates with the single illumination control 864 such that the control signal of the sequential lighting control 868 cycles to a new state near the same time the single illumination control 864 outputs a "000" signal. The sequential lighting control 868 is coupled to the circuitry which illuminates LEDs 816, 818, and 820 so that the control signal from the sequential lighting control 868 illuminates the LEDs in a sequential pattern, starting with the LED indicated by the starting LED control 866.

The short duration flashing control 870 operates to stop the illumination pattern of LEDs 816, 818, and 820 in response to a short electrical engagement after a predetermined number of cycle states. Preferably, the short duration flashing control 870 generally includes at least three flip-flops 886, 888, and 890; a switch 891; and a series of logic gates 893. In general, flip-flops 886, 888, and 890 and switch 891 are coupled to the series of logic gates 893 such that the short duration flashing control 870 produces a signal when the illumination pattern cycles through a predetermined number of cycle states. Preferably, the short duration flashing control 870 signals that the illumination pattern has cycled through the predetermined number of cycle states by changing from high to low.

Preferably, the number of cycle states that the illumination pattern cycles through before the short duration flashing control 870 produces a signal can be changed through the use of switch 891. In the embodiment shown in FIG. 8, switch 891 is configured to connect the logic gates 893 to a voltage source or ground depending on the state of switch 891. Connecting the logic gates 893 to a voltage source or ground affects the logic cycle of the short duration flashing control 870, thereby changing the number of cycle states the illumination pattern will cycle through before the series of logic gates 893 produces a low signal. For example, in the embodiment shown in FIG. 8, when switch 891 connects the logic gates 893 to ground, the illumination pattern cycles through seven voltage states before the short duration flashing control 870 produces a low signal, and when switch 891 connects the logic gates 893 to the voltage source, the illumination pattern cycles through three voltage states before the short duration flashing control 870 produces a low signal.

The long duration or fast frequency flashing control operates by controlling the outputs of the single illumination control 864, sequential lighting control 868, and short duration flashing control 870 to freeze any flashing pattern and illuminate a single LED in response to a signal from the long duration circuit 812 or the fast frequency circuit 814 of the second stage 806. As discussed above, when the long duration circuit 812 of the second stage 806 detects an electrical engagement which is longer than the predetermined duration level in the motion switch 810 or the fast frequency circuit 814 detects consecutive electrical engagements within the motion switch 810 for a given number of clock cycles, NAND gate 834 changes to low while flip-flops 896 and 898 remain at low. At this time, a clock signal does not pass to the single illumination control 864, forcing the single illumination control 864 to remain constant. Therefore, the sequential lighting control 868 and the short duration flashing control 870 do not cycle through their respective control signals due to their dependence on the single illumination control 872. As a result, LEDs 816, 818, and 820 do not flash and only the LED which is illuminated when the long duration circuit 812 or fast frequency circuit 814 signaled the third stage 808 continues to illuminate until the electrical engagement within the motion switch 810 ends. When the electrical engagement within the motion switch 810 ends, the RC oscillator 842 stops and the illuminated LED extinguishes.

In another aspect of the invention, the frequency controlled lighting system is designed using at least two integrated circuits, configured within the system to prolong use. Preferably, each integrated circuit within the system has a different cutoff operating voltage. If the supply voltage to an integrated circuit is less than its cutoff operating voltage, the integrated circuit will not function properly or at all. The cutoff operating voltage of an integrated circuit is dependent on the circuit design and manufacture of the integrated circuit. In a battery-power system such as the illustrated frequency controlled lighting system, the operating voltage level will decrease over time as the charges stored in the battery is depleted. As the voltage level of the power source within the system decreases over time, only the integrated circuits which require a high voltage level to operate will stop functioning while the integrated circuits which required a low voltage level to operate will continue functioning.

Figure 9:
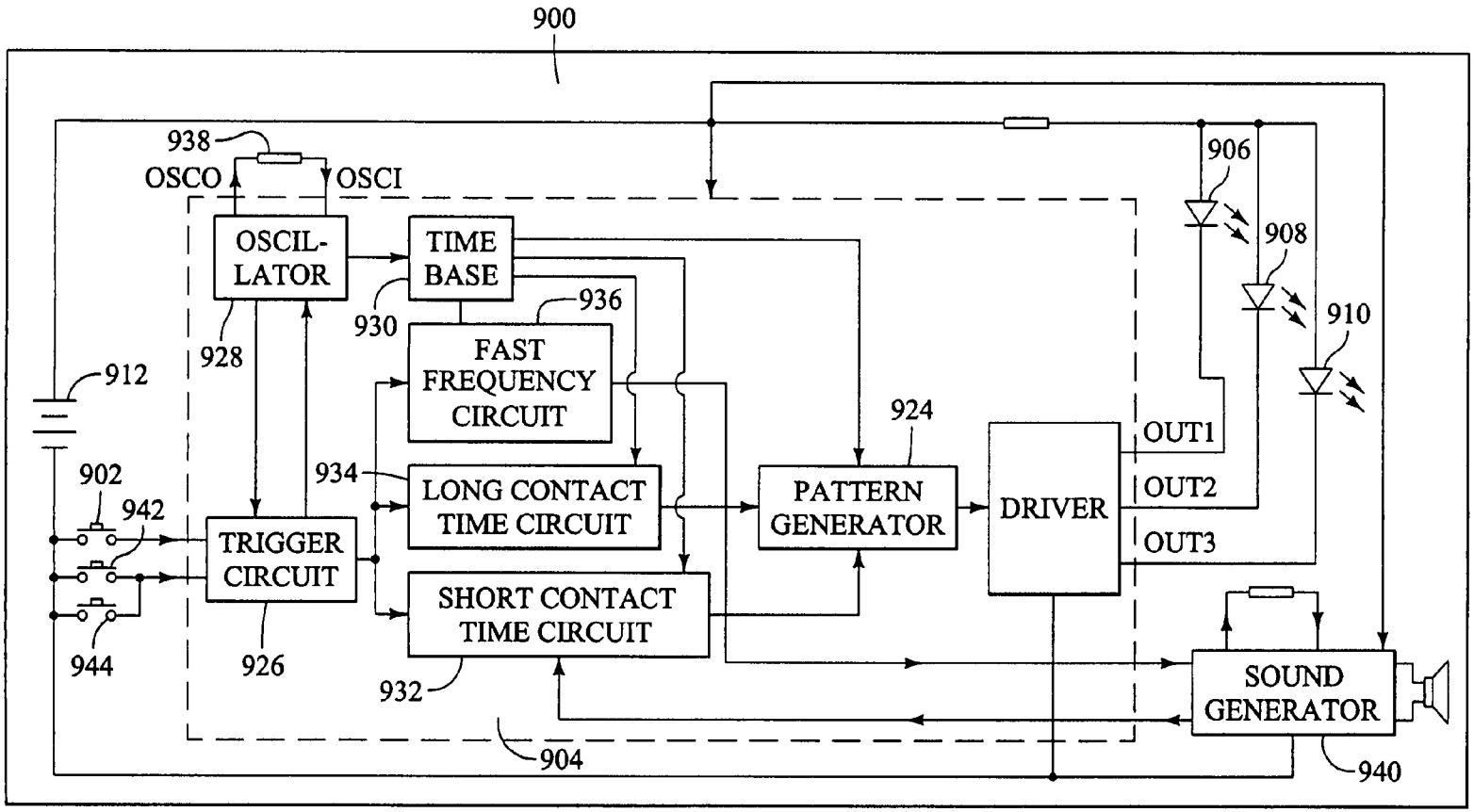
FIG. 9 is a circuit diagram of another embodiment of the frequency controlled lighting system implementing an extended-use design.

As shown in FIG. 9, an extended-use design for the frequency controlled lighting system 900 generally includes at least one power source 912, at least one motion switch 902, an integrated circuit functioning as a controller 904, an integrated circuit functioning as a sound generator 940, and a series of lighting elements 906, 908, and 910. Preferably, the integrated circuit functioning as a controller 904 and the integrated circuit functioning as a sound generator, 940 are each mounted to a printed circuit board by soldering or other conventional technique. Other methods or devices for mechanically or electrically joining the controller 904 and sound generator 940 integrated circuits may also be used.

Generally, as described above, electrical engagement within one of the motion switches 902, 942, 944 triggers the controller 904. The controller 904 analyzes the movement of the motion switches 902, 942, 944, and in response to that general movement, illuminates the series of lighting elements 906, 908, 910 in one or more predetermined patterns, or actuates the sound generator 940 to produce one or more predetermined sounds.

Preferably, the integrated circuit functioning as the controller 904 and the integrated circuit functioning as the sound generator 940 are coupled together such that the controller 904 may send an actuation signal to the sound generator 940 and the sound generator 940 may send a busy signal to the controller 904. Typically, the controller 904 sends an actuation signal to the sound generator 940 when the controller 904 detects a predetermined property in the general movement of the motion switches 902, 942, 944 such as a long duration or fast frequency. Essentially, the actuation signal actuates the sound generator 940, causing the sound generator 940 to begin producing sound.

Preferably, the sound generator 940 sends the busy signal to the controller 904 while the sound generator 940 is producing a sound. Essentially, the busy signal informs the controller 904 that the sound generator 940 is busy producing a sound and additional actuation signals should not be sent to interrupt the sound currently being produced.

In the extended-use design of the frequency controlled lighting system, the integrated circuit functioning as the sound generator 940 will have a higher cutoff operating voltage level than the integrated circuit functioning as the controller 904. For example, in one preferred embodiment, the integrated circuit functioning as the sound generator 940 will have a cutoff operating voltage of 2.4 volts while the integrated circuit functioning as the controller 904 will have a cutoff operating voltage of 2 volts. Therefore, as the voltage level of the power source 912 decreases over time, when the voltage level of the power source 912 falls below the cutoff operating voltage of the integrated circuit functioning as the sound generator 940, but remains above the cutoff operating voltage of the integrated circuit functioning as the controller 904, the sound generator 940 will no longer operate but the controller 904 will continue to operate.

During the period of time that the voltage level of the power source 912 is below the cutoff operating voltage of the sound generator 940 but above the cutoff operating voltage of the controller 904, the controller 904 will continue to send actuation signals to the sound generator 940 when the controller 904 detects one of the predetermined properties in the movement of the motion switches 902, 942, 944, but the sound generator 940 will not produce a sound, and thus not send a busy signal. Therefore, the operation of the controller 904 will not be interrupted and the controller 904 will continue to operate normally.

Figure 10:
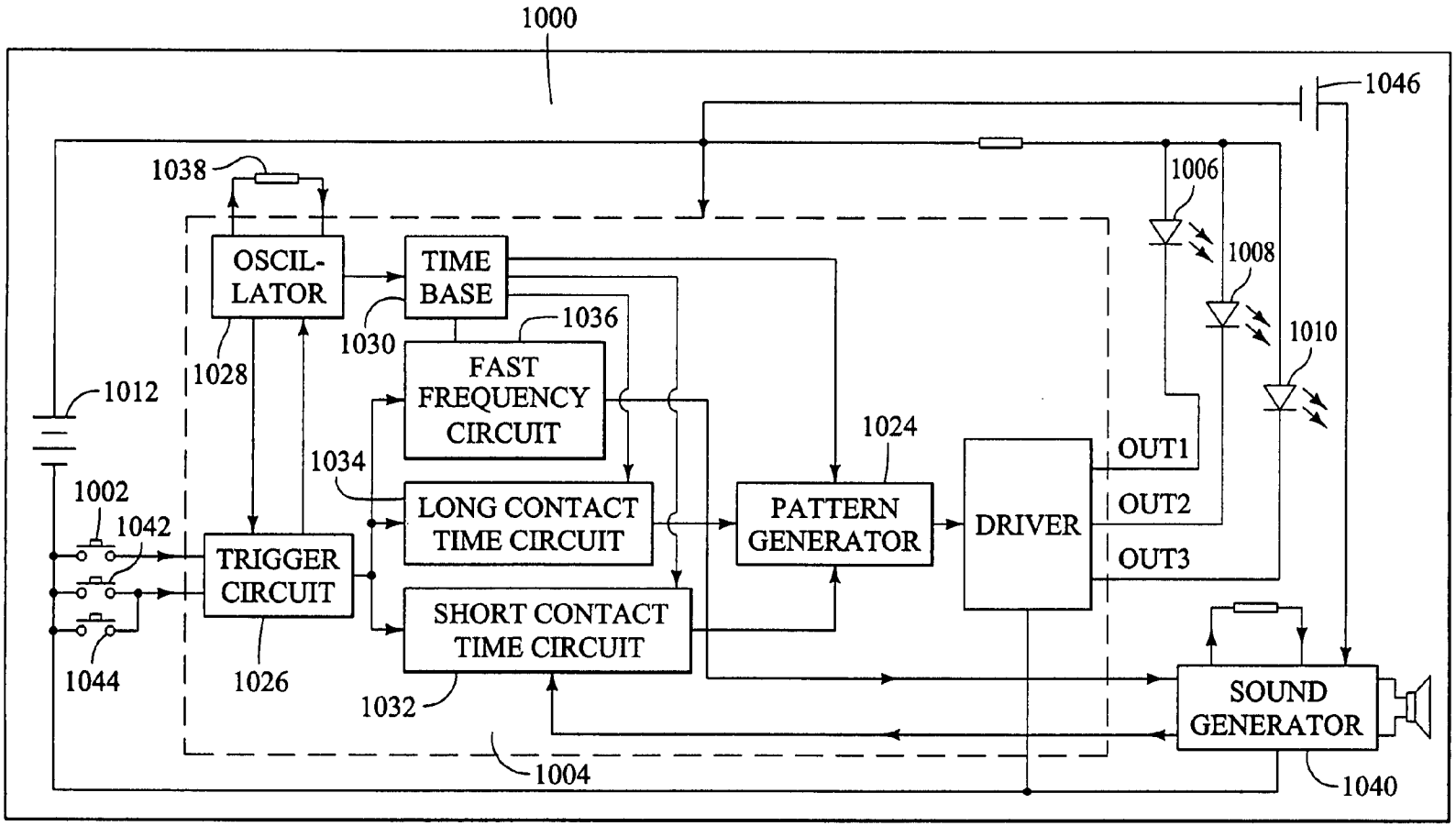
FIG. 10 is a circuit diagram of another embodiment of the frequency controlled lighting system implementing another extended-use design implementing two power sources.

In another preferred embodiment, shown in FIG. 10, the power source of the system consists of a first power source 1012 and a second power source 1046. Preferably, the first power source 1012 provides power to the at least one motion switch 1002, the integrated circuit functioning as the controller 1004, the integrated circuit functioning as the sound generator 1040, and the series of lighting elements 1006, 1008, 1010. The second power source 1046 provides additional power to the integrated circuit functioning as the sound generator 1040 only. Having the second power source 1046 which only provides power to the sound generator 1040 provides the ability to increase the potential volume of the sound generator 1040. Additionally, the second power source 1046 providing additional power to the sound generator 1040 provides a more efficient use of power so that less power is drawn from the first power source 1012 during sound production, resulting in longer operating time for all components of the system 1000.

Figure 11:
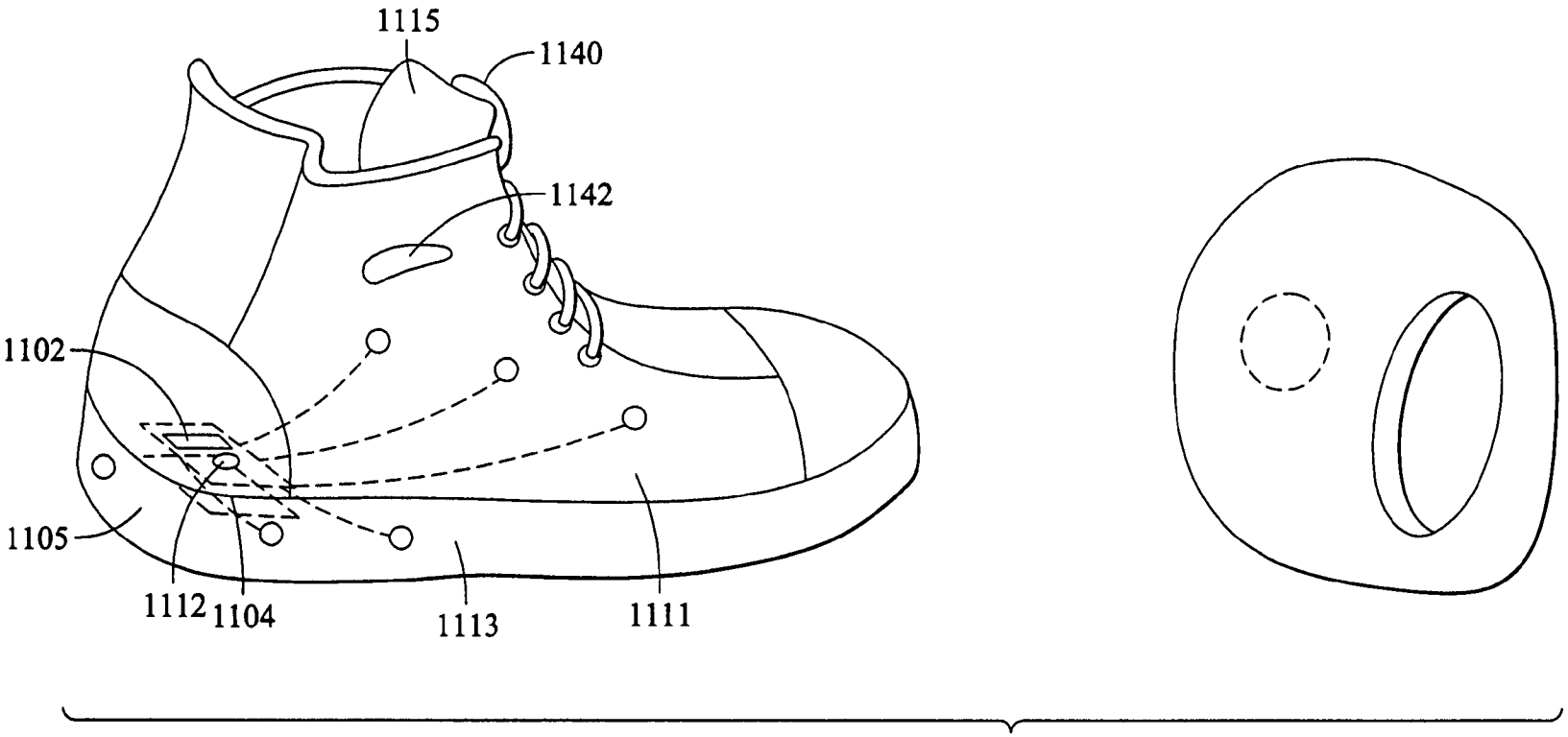
FIG. 11 is a drawing of footwear including the frequency controlled lighting system which shows the preferred placement of components of the frequency controlled lighting system in the footwear.
Figure 12:
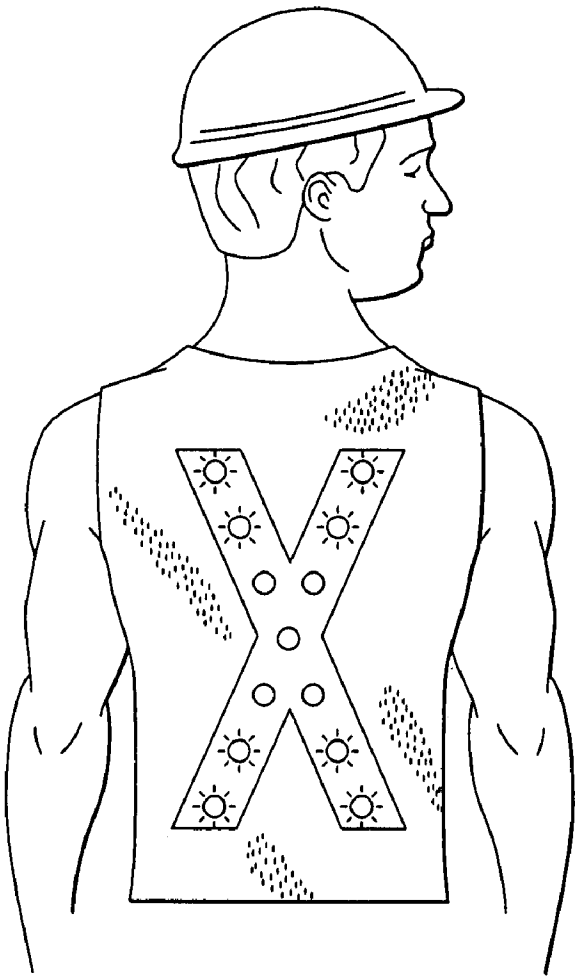
FIG. 12 is a drawing of a safety vest including the frequency controlled lighting system.
Figure 13:
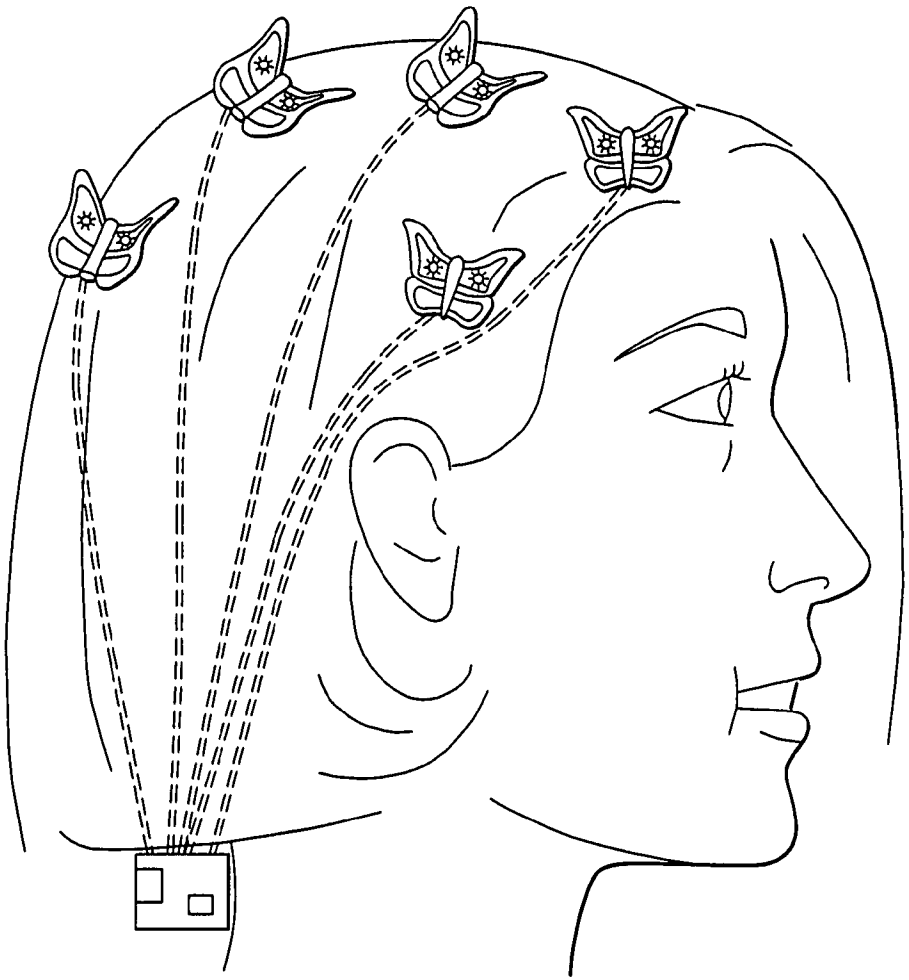
FIG. 13 is a drawing of a set of barrettes including the frequency controlled lighting system.
Figure 14:
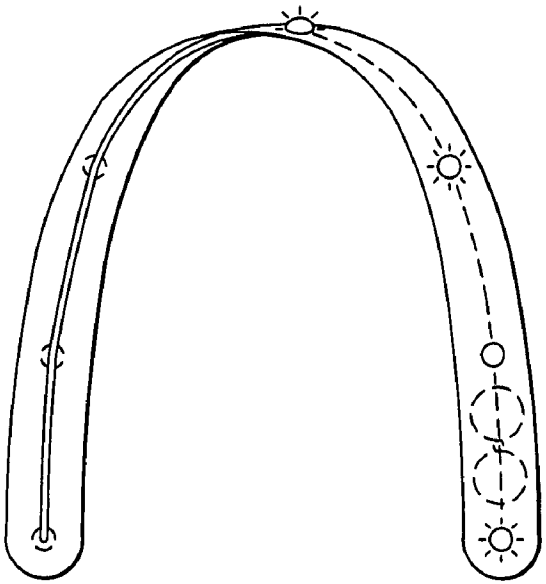
FIG. 14 is a drawing of a headband including the frequency controlled lighting system.

The components of the frequency controlled lighting system 1 can be placed anywhere throughout footwear, but an embodiment having the preferred placement of the components of the system 1 is shown in FIG. 11. Preferably, the power source 1112, the controller 1104, and the motion switch 1102 are placed in the heel 1105 of the footwear. The heel 1105 provides a large area to encapsulate the power source 1112 and the controller 1104. Additionally, during movement such as running or walking, a user normally strikes the heel 1105 against the ground with a sufficient force to activate the motion switch 1102. The LEDs 1106, 1108, and 1110 are preferably placed on the outer surface 1111 of the shoe or the sole 1113 of the shoe. Further, the sound generating device 1140 is preferably placed on the outer surface 1111 of the shoe or the tongue 1115 of the shoe.

Figure 15:
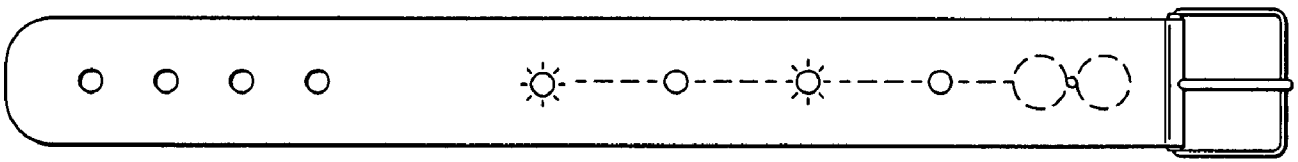
FIG. 15 is a drawing of a bracelet including the frequency controlled lighting system.

As seen in FIGS. 11–15, the frequency controlled lighting system in accordance with the present invention can be incorporated into many objects such as footwear (FIG. 11), a safety vest (FIG. 12), barrettes (FIG. 13), a headband (FIG. 14), or a bracelet (FIG. 15). In all of these objects, the frequency controlled lighting system provides a user greater visibility, thereby providing greater safety and aesthetic value for the user. The lighting system can be integrated into many other objects as well, and FIGS. 11–15 are intended to be exemplary only.

The embodiments described herein overcome issues of previous lighting systems concerning shorter-than-desired battery life due to unnecessary battery drain by allowing a user to deactivate a flashing pattern through external motions. Alleviating unnecessary power drain allows for a long-lasting product, allows for creation of smaller lighting systems, and allows for more complex lighting systems that will not drain a power source as quickly as previous less complex lighting system.

Additionally, the embodiments described herein overcome limitations of previous lighting systems by providing a frequency controlled lighting system creating multiple lighting patterns in various objects in response to movement of the lighting system. Multiple lighting patterns provides greater visibility for the user to increase safety. Additionally, multiple illumination patterns creates a more interesting lighting patterns to increase the aesthetic value of the object.

All the circuits described and many other circuits may be used in achieving the result of a frequency controlled lighting system that illuminates different lighting patterns in response to movement of a motion switch. Additionally, many of the elements of the frequency controlled lighting system may be implemented through a number of objects. For instance, while LEDs are clearly preferred, other types of lamps may also be used, such as incandescent lamps or other lamps. Further, the control and signal processing functions of the controller and the sound generator can be performed by a programmed microprocessor or other logic devices in addition to integrated circuits.

Preferably, in order to fulfill environmental protection regulations for various countries, the circuits and other objects used in the frequency controlled lighting system may consist of non-toxic components. For example, the solder and other components of the circuits may be LEAD (Pb), Cadmium, Mercury and Chromium free. Examples of LEAD free solder include Sn-07Cu, SN99, Sn—Ag3.5, and Sn—Ag—Cu provided by Shing Hing Solder Co., Ltd. As used herein, "free" means the contents of the toxic elements in the components contain less than a predefined percentage which meets the basic requirements for the environmental regulation percentages of a country.

It is therefore intended that the foregoing detailed description be regarded as illustrative rather than limiting, and that it be understood that it is the following claims, including all equivalents, that are intended to define the spirit and scope of this invention. Any of these improvements may be used in combination with other features, whether or not explicitly described as such. Other embodiments are possible within the scope of this invention and will be apparent to those of ordinary skill in the art. Therefore, the invention is not limited to the specific dates, representative embodiments, and illustrated examples in this description.

The invention claimed is:

1. A frequency controlled lighting system comprising:

at least one power source;

at least one motion switch to generate an activation signal in response to an electrical engagement within the at least one motion switch, the activation signal indicating at least one of duration and frequency of electrical engagement within the at least one motion switch;

a first integrated circuit functioning as a controller, the first integrated circuit electrically connected to the at least one motion switch to receive the activation signal;

a second integrated circuit functioning as a sound generating device, the second integrated circuit electrically connected to the first integrated circuit, the first integrated circuit actuating the second integrated circuit dependant on the duration and frequency of electrical engagement indicated by the activation signal; and lighting elements, electrically connected to the first integrated circuit, the lighting elements selectively actuated by the first integrated circuit to illuminate the lighting elements in one or more predetermined illumination patterns dependant on the duration and frequency of electrical engagement indicated by the activation signal;

wherein the second integrated circuit has a higher cutoff operating voltage than the first integrated circuit, and the first integrated circuit operates independent of whether the second integrated circuit is operating.

2. The frequency controlled lighting system of claim 1, wherein at least one of the at least one motion switch, the first integrated circuit, the second integrated circuit, and the lighting elements is a non-toxic component.

3. A frequency controlled lighting system comprising:

at least one power source;

a motion switch comprising:

a spring having a fixed end and a free end, and a metal contact positioned proximate the free end of the spring for electrical engagement by the free end of the spring, wherein the motion switch generates an activation signal in response to motion of the motion switch, the activation signal indicating at least a duration of time that the spring electrically engages the metal contact;

a first integrated circuit functioning as a controller, the first integrated circuit electrically connected to the motion switch to receive the activation signal, the controller comprising:

a signal analysis system to analyze the activation signal, and a pattern generator to receive commands from the signal analysis system and generate a dependant illumination pattern;

lighting elements electrically connected to the first integrated circuit, the lighting elements selectively actuated by the pattern generator to illuminate the lighting elements in one or more of a series of predetermined illumination patterns dependant upon commands from the signal analysis system; and a second integrated circuit functioning as a sound generator, the second integrated circuit electrically connected to the first integrated circuit, the first integrated circuit actuating the second integrated circuit dependant upon commands from the signal analysis system;

wherein the second integrated circuit has a higher cutoff operation voltage than the first integrated circuit, and the first integrated circuit operates independent of whether the second integrated circuit is operating.

4. The frequency controlled lighting system of claim 3, wherein at least one of the motion switch, the first integrated circuit, the second integrated circuit, and the lighting elements is a non-toxic component.

5. A frequency controlled lighting system comprising:

at least one power source;

at least one motion switch to generate an activation signal in response to an electrical engagement within the at least one motion switch, the activation signal indicating at least one of duration and frequency of electrical engagement within the at least one motion switch;

a controller, electrically connected to the at least one motion switch to receive the activation signal;

a sound generating device, electrically connected to the controller, the controller actuating the sound generating device dependant on the duration and frequency of electrical engagement indicated by the activation signal; and lighting elements, electrically connected to the controller, the lighting elements selectively actuated by the controller to illuminate the lighting elements in one or more predetermined illumination patterns dependant on the duration and frequency of electrical engagement indicated by the activation signal;

wherein the sound generating device has a higher cutoff operating voltage than the controller, and the controller operates independent of whether the sound generating device is operating.

6. The frequency controlled lighting system of claim 5, wherein at least one of the at least one motion switch, the controller, the sound generating device, and the lighting elements is a non-toxic component.

7. A frequency controlled lighting system comprising:

a first motion switch to generate a first activation signal in response to electrical engagement within the first motion switch, the first activation signal indicating at least one of duration and frequency of electrical engagement within the first motion switch;

a second motion switch to generate a second activation signal in response to electrical engagement within the second motion switch, the second activation signal indicating at least one of duration and frequency of electrical engagement within the second motion switch;

at least one integrated circuit, the at least one integrated circuit electrically coupled with the first motion switch and the second motion switch to receive the first activation signal and the second activation signal;

lighting elements, electrically coupled with the at least one integrated circuit, the lighting elements selectively actuated by the at least one integrated circuit to illuminate the lighting elements in one or more predetermined illumination patterns dependant on the duration and frequency of electrical engagement indicated by the first motion switch; and a sound generating unit, electrically coupled with the at least one integrated circuit, the sound generating unit actuated by the at least one integrated circuit to generate a first sound indicated by the second motion switch.

8. The frequency controlled lighting system of claim 7, further comprising:

a third motion switch, electrically coupled to the at least one integrated circuit, to generate a third activation signal in response to electrical engagement within the third motion switch, the third activation signal indicating at least one of duration and frequency of electrical engagement within the third motion switch;

wherein the sound generating unit is actuated by the at least one integrated circuit to generate a second sound indicated by the third motion switch.

9. A frequency controlled lighting system comprising:

a first motion switch to generate a first activation signal in response to electrical engagement within the first motion switch, the first activation signal indicating at least one of duration and frequency of electrical engagement within the first motion switch;

a second motion switch to generate a second activation signal in response to electrical engagement within the second motion switch, the second activation signal indicating at least one of duration and frequency of electrical engagement within the second motion switch;

at least two integrated circuits electrically coupled with each other, wherein a fist integrated circuit is electrically coupled with the first motion switch to receive the first activation signal and a second integrated circuit is electrically coupled with the second motion switch to receive the second activation signal;

lighting elements, electrically coupled with the first integrated circuit, the lighting elements selectively actuated by the first integrated circuit to illuminate the lighting elements in one or more predetermined illumination patterns dependant on the duration and frequency of electrical engagement indicated by the first motion switch; and a sound generating unit, electrically coupled with the second integrated circuit, the sound generating unit actuated by the second integrated circuit to generate a sound indicated by the second motion switch.

* * * * *